US009434173B2

(12) United States Patent
Kubota et al.

(10) Patent No.: US 9,434,173 B2
(45) Date of Patent: Sep. 6, 2016

(54) FLUID EJECTING APPARATUS

(71) Applicant: Seiko Epson Corporation, Tokyo (JP)

(72) Inventors: Tomoo Kubota, Shiojiri-shi (JP); Takayuki Shiota, Kitakyushu-shi (JP); Noriyuki Koyanagi, I, Kitakyushu-shi (JP); Atsushi Kobayashi, Matsumoto-shi (JP); Kazuhiro Nishiwake, Shiojiri-shi (JP); Tadahiro Mizutani, Shiojiri-shi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/749,028

(22) Filed: Jun. 24, 2015

(65) Prior Publication Data

US 2015/0375544 A1 Dec. 31, 2015

(30) Foreign Application Priority Data

Jun. 25, 2014 (JP) ..... 2014-130105

(51) Int. Cl.
*B41J 2/175* (2006.01)

(52) U.S. Cl.
CPC ..... *B41J 2/17526* (2013.01); *B41J 2/17553* (2013.01)

(58) Field of Classification Search
CPC ..... B41J 2002/14491; B41J 2/14072; B41J 2/1623; B41J 2202/20; B41J 2/14024; B41J 2/17526; B41J 2/17553
USPC ..... 347/50
See application file for complete search history.

(56) References Cited

U.S. PATENT DOCUMENTS

| | | | | |
|---|---|---|---|---|
| 6,502,917 | B1 * | 1/2003 | Shinada | D06M 13/44 347/19 |
| 7,237,881 | B2 * | 7/2007 | Hayasaki | B41J 2/17546 347/19 |
| 2008/0070437 | A1 * | 3/2008 | Nakano | B41J 2/1752 439/367 |
| 2010/0079553 | A1 * | 4/2010 | Katoh | B41J 2/0451 347/68 |
| 2011/0205312 | A1 * | 8/2011 | Miyata | B41J 2/14233 347/70 |
| 2012/0056955 | A1 * | 3/2012 | Kodama | B41J 2/1752 347/86 |

FOREIGN PATENT DOCUMENTS

| | | |
|---|---|---|
| JP | 2008-993 | 1/2008 |
| JP | 2014-034147 | 2/2014 |

* cited by examiner

*Primary Examiner* — Manish S Shah
*Assistant Examiner* — Yaovi M Ameh

(57) ABSTRACT

A printing apparatus includes a cartridge, and a wiring cable which can transmit an electrical signal to the cartridge. The carriage is provided with a connector unit and a wiring board in a holder unit on which the cartridge is mounted. First and second electrode portions, and a connector unit are arranged on a first face of the wiring board. The wiring board is arranged at a position of being overlapped with the cartridge in a direction which goes along an arrow Y. A width of the wiring board in an arrow X direction is the same as a width of a cartridge arranging region in the holder unit, or is smaller than that.

13 Claims, 21 Drawing Sheets

10B

Z
X
Y
27B, 200B
203
213
214
215
210
204
205
212
216
250
285
232, 230
283, 291 TO 299
280B
202
PW
CW

FLUID EJECTING APPARATUS

CROSS-REFERENCE TO RELATED APPLICATION(S)

This application claims priority to Japanese Patent Application No. 2014-130105, filed on Jun. 25, 2014. The entire disclosure of Japanese Patent Application No. 2014-130105 is hereby incorporated herein by reference.

BACKGROUND

1. Technical Field

The present invention relates to a fluid ejecting apparatus.

2. Related Art

As an aspect of a fluid ejecting apparatus which ejects a fluid, for example, an ink jet printer (hereinafter, also simply referred to as "printer") is known. The printer forms an image by ejecting ink droplets onto a printing face. The printer receives a supply of ink through an ink cartridge (hereinafter, also simply referred to as "cartridge") which is an aspect of a fluid supply unit. The cartridge is usually detachably mounted on a carriage which is provided in a printer (for example, JP-A-2008-993, JP-A-2014-34147, or the like). A terminal portion, or the like, provided in a carriage, is used for exchanging electrical signals between a printer and a cartridge.

In a printer, it was desirable to miniaturize a carriage from the related art, and repeated researches are carried out on a daily basis.

SUMMARY

The invention can be realized in the following forms in a fluid ejecting apparatus which has a configuration corresponding to a carriage without being limited to a printer.

[1] According to an aspect of the invention, a fluid ejecting apparatus is provided. The fluid ejecting apparatus includes a carriage unit and a wiring cable. In the carriage unit, a fluid supply unit may be arranged. The wiring cable may transmit an electrical signal which is transmitted to the fluid supply unit. The carriage unit may include a fluid supply unit arranging region, a connector unit, and a wiring base. In the fluid supply unit arranging region, the fluid supply unit may be arranged. The connector unit may be in electrical contact with the fluid supply unit. The wiring base may be electrically connected to the connector unit. The wiring base may include an electrode portion which is configured to be in electrical contact with the connector unit, and a cable connection portion which is electrically connected to the electrode portion, and to which the wiring cable is connected on a base face which faces the fluid supply unit arranging region side. The wiring base may be arranged in a position of being overlapped with the fluid supply unit which is arranged in the fluid supply unit arranging region when viewed along a first direction which goes toward the fluid supply unit arranging region from the wiring base. A width of the wiring base in a second direction which goes toward the cable connection portion from the electrode portion, and goes along the base face may be the same as a width of the fluid supply unit arranging region in the second direction, or may be smaller than the width of the fluid supply unit arranging region in the second direction. According to the fluid ejecting apparatus, it is possible to miniaturize the carriage unit in the first direction, since the electrode portion and the cable connection portion are integrated on the base face of the wiring base. In addition, since a width of the wiring base in the second direction is defined so as to be the same as a width of the fluid supply unit arranging region in the second direction, or to be smaller than the width of the fluid supply unit arranging region in the second direction, it is possible to miniaturize the carriage in the second direction.

[2] In the fluid ejecting apparatus, the connector unit and the cable connection portion may be arranged in a position of being overlapped with the fluid supply unit which is arranged in the fluid supply unit arranging region in the first direction. According to the fluid ejecting apparatus, the electrode portion and the cable connection portion which are arranged in the second direction in the wiring base are integrated at a position facing the fluid supply unit. Accordingly, it is possible to further miniaturize the carriage unit in the second direction.

[3] In the fluid ejecting apparatus, the carriage unit may be configured so as to reciprocate along the second direction. According to the fluid ejecting apparatus, since the carriage unit is miniaturized in the second direction, it is possible to increase a reciprocating range of the carriage unit in a limited space in the fluid ejecting apparatus.

[4] In the fluid ejecting apparatus, the cable connection portion may be a fitting connection unit which is attached to the base face, and to which the wiring cable is configured to be connected in a fitting manner. According to the fluid ejecting apparatus, it is possible to increase a connection property of the wiring cable with respect to the cable connection portion while miniaturizing the carriage unit in the first direction.

[5] In the fluid ejecting apparatus, the fitting connection unit may be configured so as to connect the wiring cable along the second direction. According to the fluid ejecting apparatus, it is possible to further miniaturize the carriage unit in the first direction.

[6] In the fluid ejecting apparatus, the cable connection portion may be a portion at which the wiring cable is soldered to the wiring base. According to the fluid ejecting apparatus, it is possible to miniaturize the cable connection portion in the first direction, and to further miniaturize the carriage unit in the first direction.

[7] In the fluid ejecting apparatus, the carriage unit may include a retaining portion which is configured to limit movement of the fluid supply unit in a direction in which the fluid supply unit is separated from the fluid supply unit arranging region, and the retaining portion may be arranged in a position of being overlapped with at least a part of the wiring base, and at least a part of the connector unit, when the carriage unit is viewed along a third direction which intersects the first direction and the second direction. According to the fluid ejecting apparatus, since it is possible to arrange the retaining portion which retains the fluid supply unit, the connector unit, and the wiring base in an integrating manner, the carriage unit can be miniaturized.

[8] In the fluid ejecting apparatus, the carriage unit may be configured so as to arrange at least first and second fluid supply units as the fluid supply unit, may include at least a first connector unit which is configured to be electrically connected to the first fluid supply unit, and a second connector unit which is configured to be electrically connected to the second fluid supply unit, and the first and second fluid supply units may be respectively arranged at end portions one by one in the second direction, in the fluid supply unit arranging region. According to the fluid ejecting apparatus, it is possible to miniaturize the carriage unit in which two or more fluid supply units can be arranged.

[9] In the fluid ejecting apparatus, the wiring base may include at least a first electrode portion which is configured to be electrically connected to the first connector unit, and a second electrode portion which is configured to be electrically connected to the second connector unit, and the wiring base may further include a wiring group which electrically connects the wiring cable and the first and second electrode portions in parallel through the cable connection portion. According to the aspect of the fluid ejecting apparatus, it is possible to connect the wiring cable and the first and second electrode portions in a simple configuration, and to miniaturize the wiring base.

[10] In the fluid ejecting apparatus, a width of the second fluid supply unit in the second direction may be larger than that of the first fluid supply unit, the cable connection portion may be formed at a position of being overlapped with the second fluid supply unit in the first direction along with the second electrode portion. According to the fluid ejecting apparatus, it is possible to secure an arranging region of the cable connection portion between the second fluid supply unit and the wiring base, and to increase space use efficiency.

[12] In the fluid ejecting apparatus, the fluid supply unit may include a first portion which is overlapped with the connector unit, and a second portion which is overlapped with the cable connection portion in the first direction, a terminal portion which is configured to be in electrical contact with the connector unit may be arranged at the first portion, and the terminal portion may protrude on the connector unit side compared to the second portion, in the first direction. According to the fluid ejecting apparatus, it is possible to increase use efficiency of a space between the wiring base and the fluid supply unit.

[13] The fluid ejecting apparatus may further include the fluid supply unit which is arranged in the carriage unit. The fluid supply unit may include a housing which is arranged in the fluid supply unit arranging region, and a fluid introduction pipe which communicates with the housing. According to the fluid ejecting apparatus, it is possible to miniaturize the carriage unit due to miniaturization of the housing which is arranged in the fluid supply unit arranging region.

[14] In the fluid ejecting apparatus, the fluid supply unit may include a fluid container which communicates with the fluid introduction pipe. According to the fluid ejecting apparatus, it is possible to further miniaturize the housing of the fluid supply unit, and to further miniaturize the carriage unit.

All of a plurality of constituent elements in each aspect of the above described invention are not essential, and it is possible to perform a change, a deletion, a replacement with another new constituent element, a partial deletion of limited contents appropriately with respect to a part of the plurality of constituent elements in order to solve a part or all of above described problems, or to achieve a part or all of effects which are described in the specifications. In addition, it is also possible to set a part or all of the technical features which are included in the above described aspect of the invention to be an independent aspect of the invention, by combining a part or all of technical features which are included in another aspect of the above described invention, in order to solve a part or all of above described problems, or to achieve a part or all of effects which are described in the specification.

The invention can be executed in various forms other than the fluid ejecting apparatus. For example, it is possible to execute the invention in a form of a carriage unit or a fluid supply unit which is included in a fluid ejecting apparatus, a holder unit in which a fluid supply unit is arranged, or the like. In addition, the invention can be executed in a form of an electrical connection unit, an electrical connection structure, or the like, between a fluid ejecting apparatus and a fluid supply unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
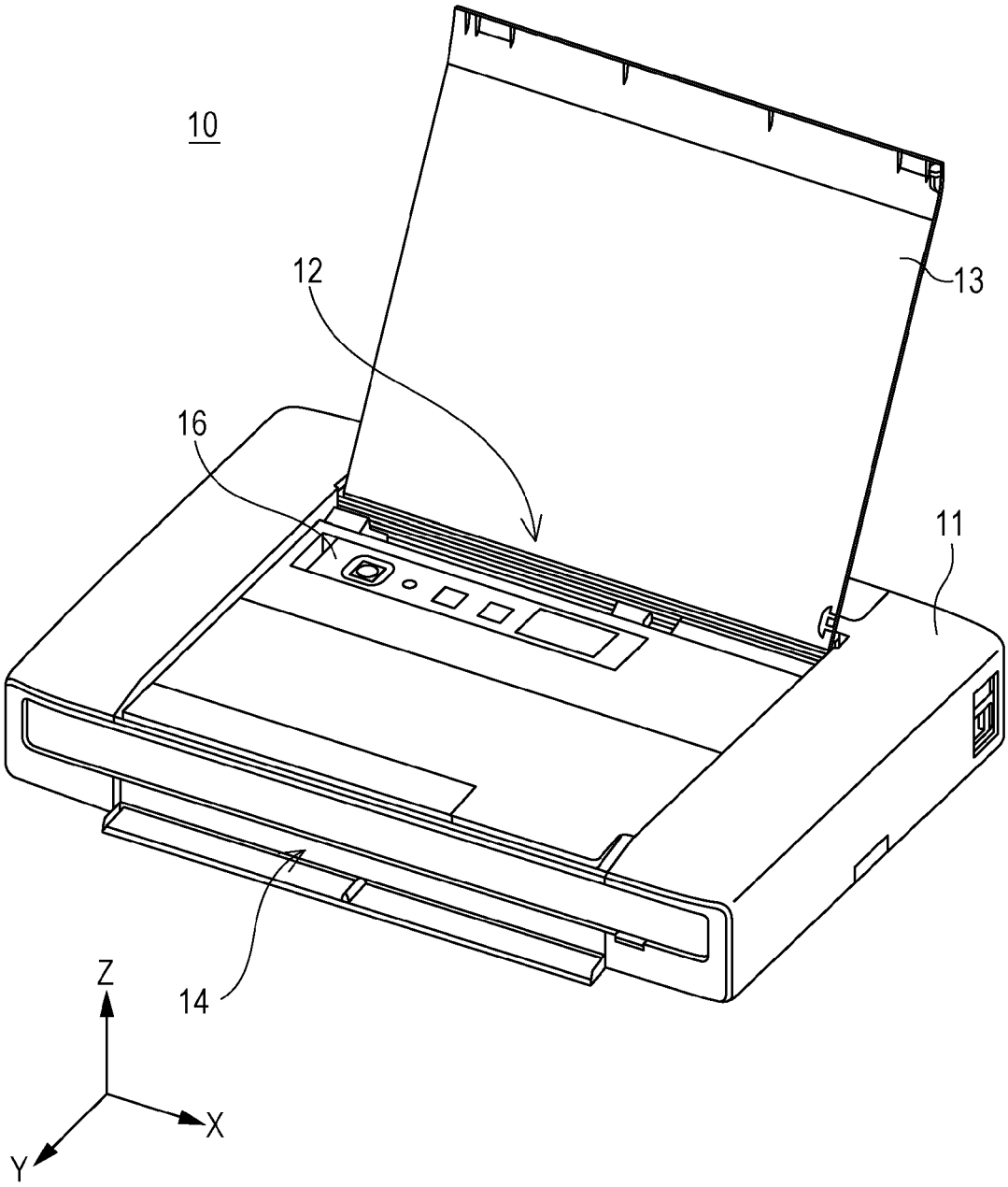
FIG. 1 is a schematic perspective view which illustrates an exterior configuration of a printing apparatus.

A. First Embodiment:

FIG. 1 is a schematic perspective view which illustrates an exterior configuration of a printing apparatus 10 according to a first embodiment of the invention. FIG. 1 illustrates arrows X, Y, and Z which denote three directions which are orthogonal to each other. The arrow X denotes a horizontal direction which is parallel to a vertical direction (width direction) of the printing apparatus 10, and denotes a direction from the left side to the right side when a user confronts the printing apparatus 10. According to the embodiment, the direction of the arrow X is parallel to a main scanning direction of a carriage 27 in the printing apparatus 10 (it will be described later). The arrow Y denotes a direction parallel to an anterior-posterior direction of the printing apparatus 10, and denotes a direction from the rear side (rear surface side) to the front side (front surface side) when a user confronts the printing apparatus 10. The arrow Y direction matches the sub-scanning direction (which will be described later). The arrow Z denotes a height direction of the printing apparatus 10, and denotes a vertically higher part with respect to a placing face on which the printing apparatus 10 is placed. In addition, also in each view which is used when describing the specification, the arrows X, Y, and Z are appropriately illustrated so as to correspond to FIG. 1. In addition, in the specification, when referring to "left" or "right", it means a direction based on the arrow X direction. Similarly, when referring to "front" or "rear", it means a direction based on the arrow Y direction of the printing apparatus 10, and when referring to "upper" or "lower", it means a direction based on the arrow Z direction of the printing apparatus 10.

The printing apparatus 10 is an ink jet printer as one embodiment of a fluid ejecting apparatus. The printing apparatus 10 forms an image by ejecting ink droplets onto a printing sheet according to printing data which is supplied from the outside. The printing apparatus 10 includes a housing 11, a sheet feeding port 12, an upper face cover 13, a sheet discharging port 14, and an operation portion 16. The housing 11 is an exterior member which accommodates a printing mechanism unit (which will be described later) of the printing apparatus 10. The sheet feeding port 12 is an opening portion which is provided so as to open to the upper part in the rear part of the housing 11. A printing sheet as a printing medium is supplied to a main body unit in the inside of the housing 11 through the sheet feeding port 12.

The upper face cover 13 is a plate-shaped member which is rotatably attached to the housing 11 in the vicinity of the sheet feeding port 12. When the upper face cover 13 is in an open state (illustrated state), the cover functions as a guide plate when sending a printing sheet into the sheet feeding port 12, and functions as a cover unit which protects a center of an upper face of the housing 11 by covering thereof in a closed state. The sheet discharging port 14 is an opening portion which is provided on the front face of the housing 11. The printing sheet which is sent into the housing 11 through the sheet feeding port 12 is discharged to the outside through the sheet discharging port 14. The operation portion 16 includes a button which receives an operation of a user, or a display unit which displays information with respect to the user. The operation portion 16 is provided on the upper face of the housing 11, and it is possible for a user to access the operation portion 16 when the upper face cover 13 is in an open state.

Figure 2:
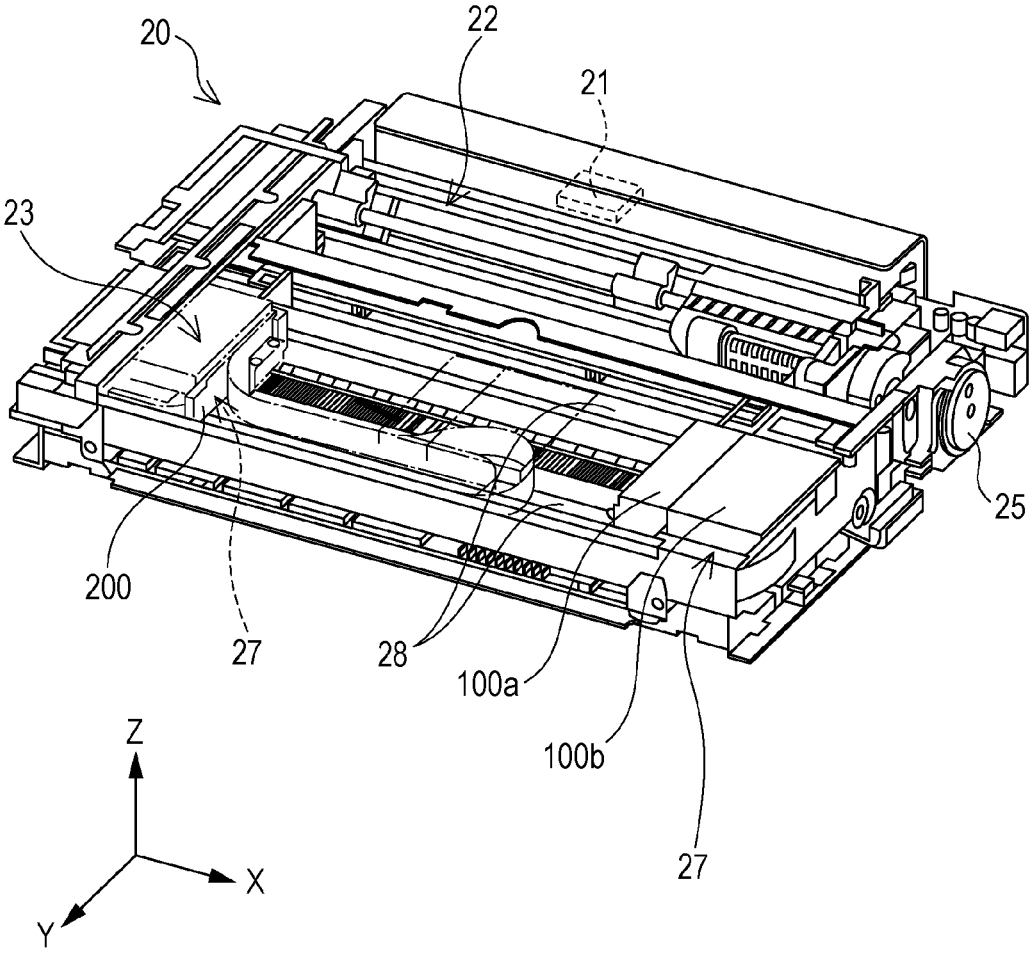
FIG. 2 is a schematic perspective view which illustrates an exterior configuration of a printing mechanism unit which is included in the printing apparatus.

FIG. 2 is a schematic perspective view which illustrates an exterior configuration of a printing mechanism unit 20 which is taken out from the inside of the housing 11 of the printing apparatus 10. In FIG. 2, movement locus of the carriage 27 is schematically denoted by a dashed line. The printing mechanism unit 20 includes a control unit 21, a transport unit 22, and a printing unit 23. The control unit 21 is configured of a microcomputer which includes a central processing unit and a main storage device. The control unit 21 executes a printing process by controlling each configuration unit of the printing apparatus 10 according to an operation of a user through the operation portion 16, or a command from an external computer.

The transport unit 22 transports a printing sheet which is introduced from the sheet feeding port 12 (FIG. 1) to the sheet discharging port 14 through a transport path (not illustrated) which extends in the arrow Y direction in the inside of the printing mechanism unit 20 due to a rotational driving of a transport roller 25. A sub-scanning direction which is a sheet feeding direction matches the arrow Y direction at a position on the lower side of the carriage 27 of the printing apparatus 10.

The printing unit 23 is arranged on a transport path of a printing sheet, and executes printing with respect to the printing sheet which is transported by the transport unit 22. The printing unit 23 includes the carriage 27, and a guide rail 28. The carriage 27 corresponds to a carriage unit. The printing apparatus 10 according to the embodiment is a so-called on-carriage type, and two cartridges 100*a* and 100*b* are detachably mounted on the carriage 27 through a holder unit 200. A printing head (not illustrated) which ejects ink droplets is provided on the lower side of the carriage 27. The first and second cartridges 100*a* and 100*b* respectively supply ink to the printing head.

The printing head includes an ink flow path, nozzles which eject ink, and a mechanism which causes a driving force for ejection of ink (for example, piezoelectric element in case of piezoelectric type, heater in case of a thermal type, or the like). The carriage 27 ejects ink droplets toward a sheet face of a printing sheet which is transported in the sub-scanning direction using the transport unit 22 while reciprocating along the guide rail 28 which is installed in the arrow X direction under a control of the control unit 21. A main scanning direction in which the carriage 27 reciprocates is parallel to the arrow X direction.

Figure 3:
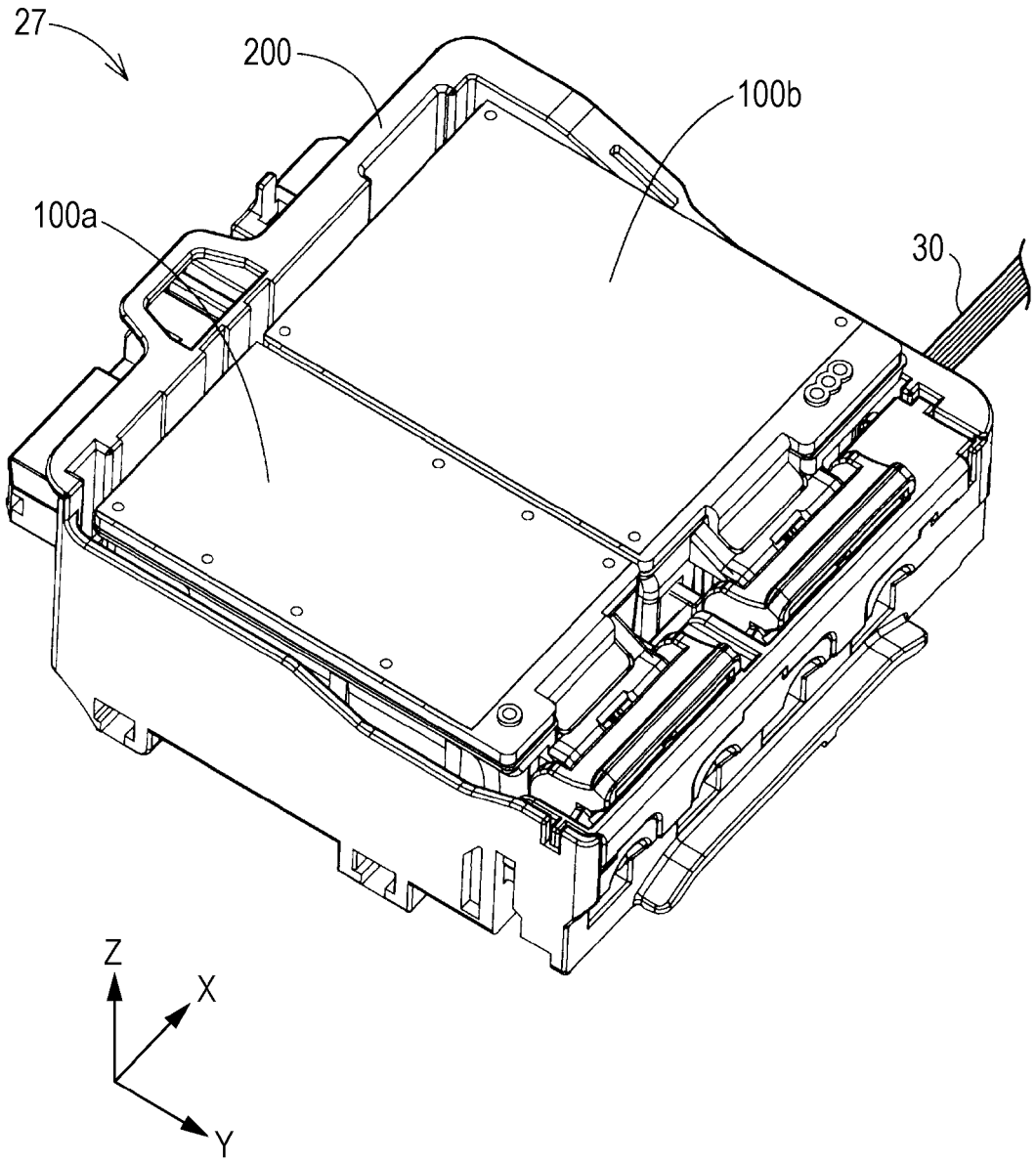
FIG. 3 is a schematic perspective view which illustrates a carriage in a state of being mounted with first and second cartridges.
Figure 6:
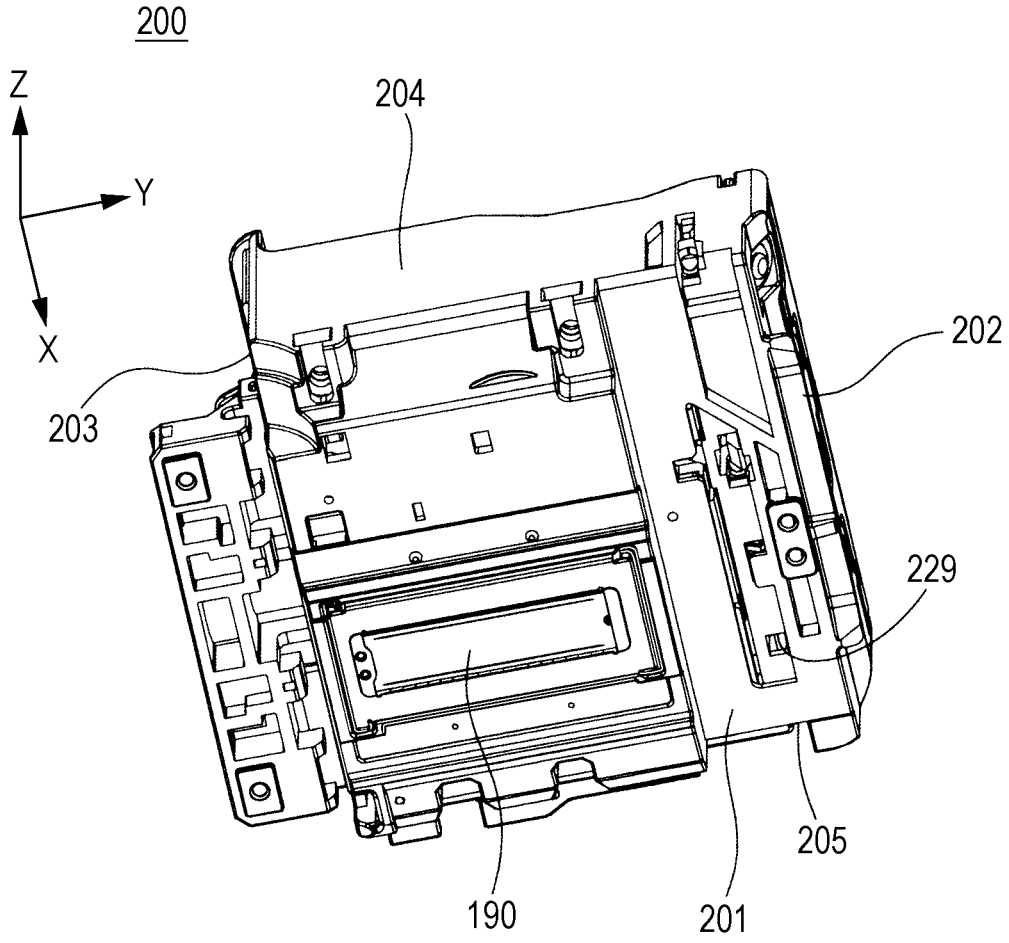
FIG. 6 is a lower part perspective view of the holder unit.

FIG. 3 is a schematic perspective view which illustrates the carriage 27 in a state of being mounted with the first and second cartridges 100*a* and 100*b*. The holder unit 200 of the carriage 27 is configured as an approximately rectangular parallelepiped box body of which the upper part is open. The respective first and second cartridges 100*a* and 100*b* are accommodated inside the holder unit 200 in parallel in a state in which the entire higher face is exposed to the upper part. The printing head is provided on the lower face of the holder unit 200. The printing head is illustrated in FIG. 6 which is referred to when describing the holder unit 200.

The first and second cartridges 100*a* and 100*b* have an approximately rectangular parallelepiped shape, respectively. A length (length in arrow Y direction) and a height (length in arrow Z direction) of the first cartridge 100*a* are approximately the same as those of the second cartridge 100*b*. The first and second cartridges 100*a* and 100*b* are accommodated in the holder unit 200 in parallel in a state in which the length and the height are approximately aligned.

Though it will be described in detail later, configurations of the first and second cartridges 100*a* and 100*b* are approximately common. In the following descriptions, when it is not necessary to distinguish the first cartridge 100*a* from the second cartridge 100*b* in particular, the cartridges are generically named as a "cartridge 100".

The cartridge 100 corresponds to a fluid supply unit, and accommodates ink to be supplied to the print head. The first cartridge 100*a* accommodates color ink of one type, and the second cartridge 100*b* accommodates a plurality of color inks of different types. According to the embodiment, black color ink is accommodated in the first cartridge 100*a*, and color ink of cyan, yellow, and magenta are accommodated in the second cartridge 100*b*.

Here, the printing apparatus 10 includes a wiring cable 30 for transmitting electrical signals between the printing apparatus and the cartridge 100. According to the embodiment, the wiring cable 30 is configured of a flexible flat cable (FFC). The wiring cable 30 is connected to the electrical connection unit which is provided in the carriage 27, and the printing apparatus 10 exchanges electrical signals between the printing apparatus and the cartridge 100 through the electrical connection unit.

In the printing apparatus 10 according to the embodiment, the carriage 27 is miniaturized by devising a layout of a component unit which includes an arranging space of the cartridge 100 and the electrical connection unit in the holder unit 200 of the carriage 27. Hereinafter, a configuration of the holder unit 200 which is provided in the carriage 27, and respective configuration of the first and second cartridges 100*a* and 100*b* will be described in order, and the layout of the component unit in the holder unit 200 will be described thereafter.

Configuration of Holder Unit (i) Entire Configuration of Holder Unit

Figure 4:
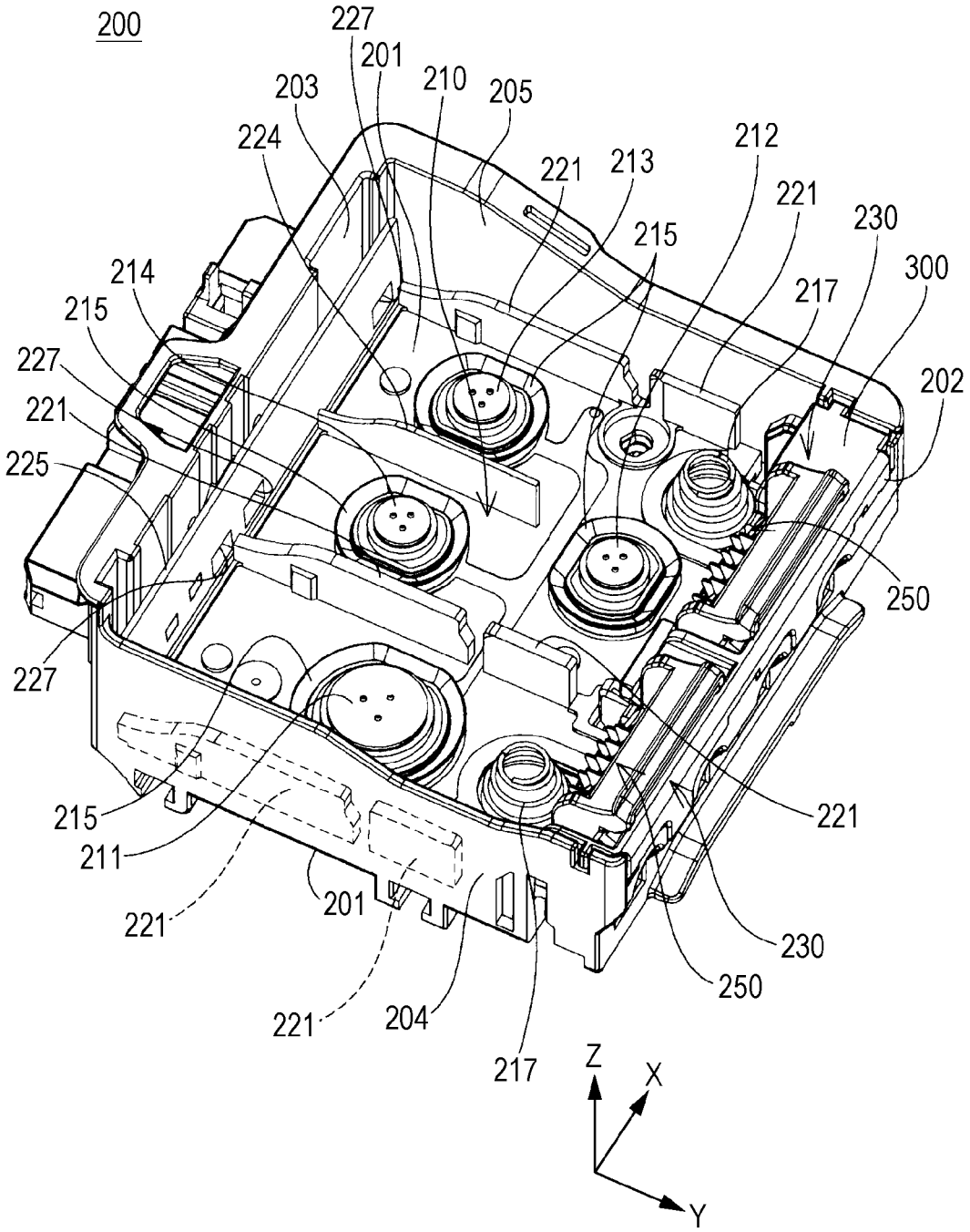
FIG. 4 is an upper part perspective view of a holder unit when being viewed from above on the front side.
Figure 5:
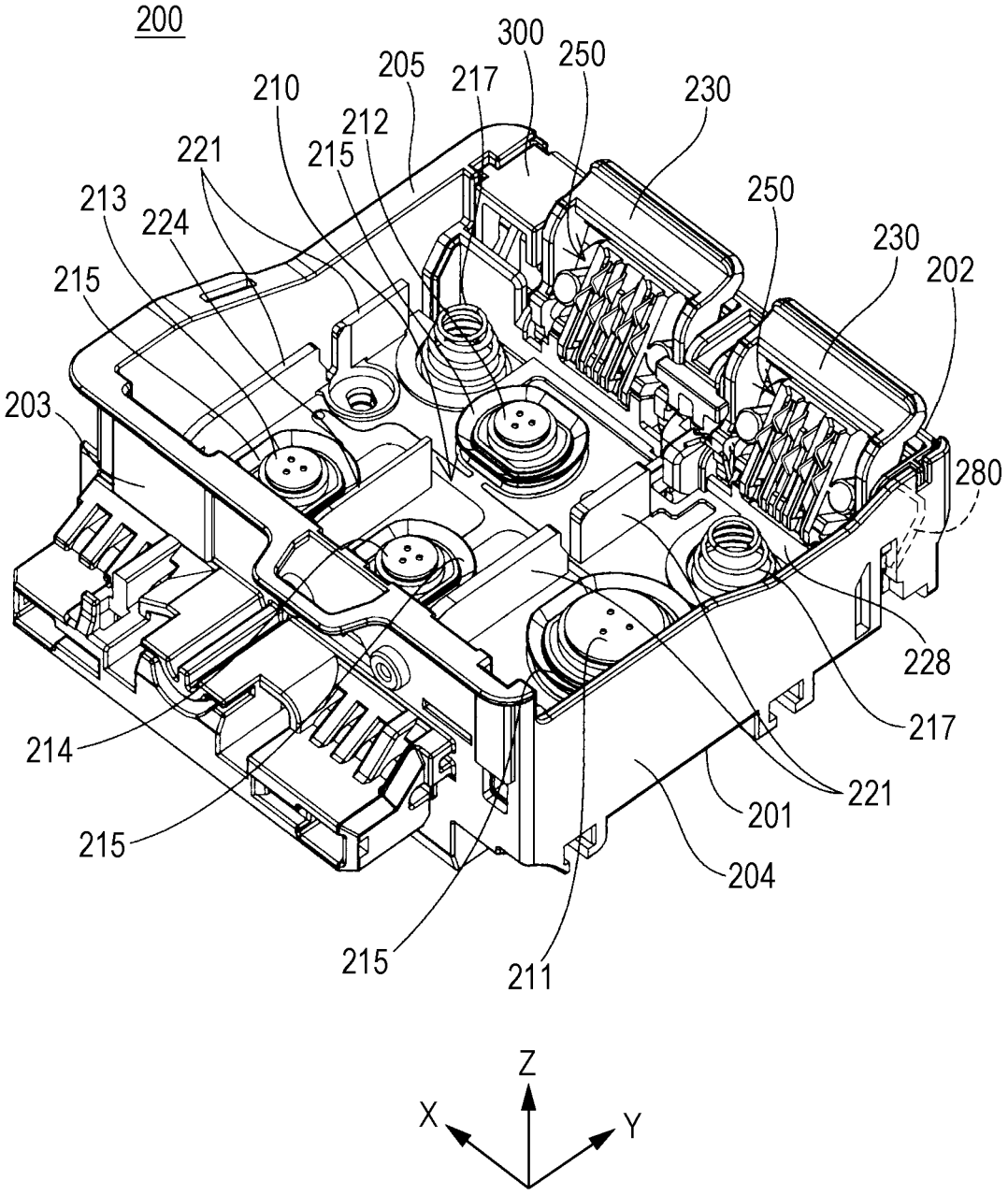
FIG. 5 is an upper part perspective view of the holder unit when being viewed from the rear surface side.
Figure 7:
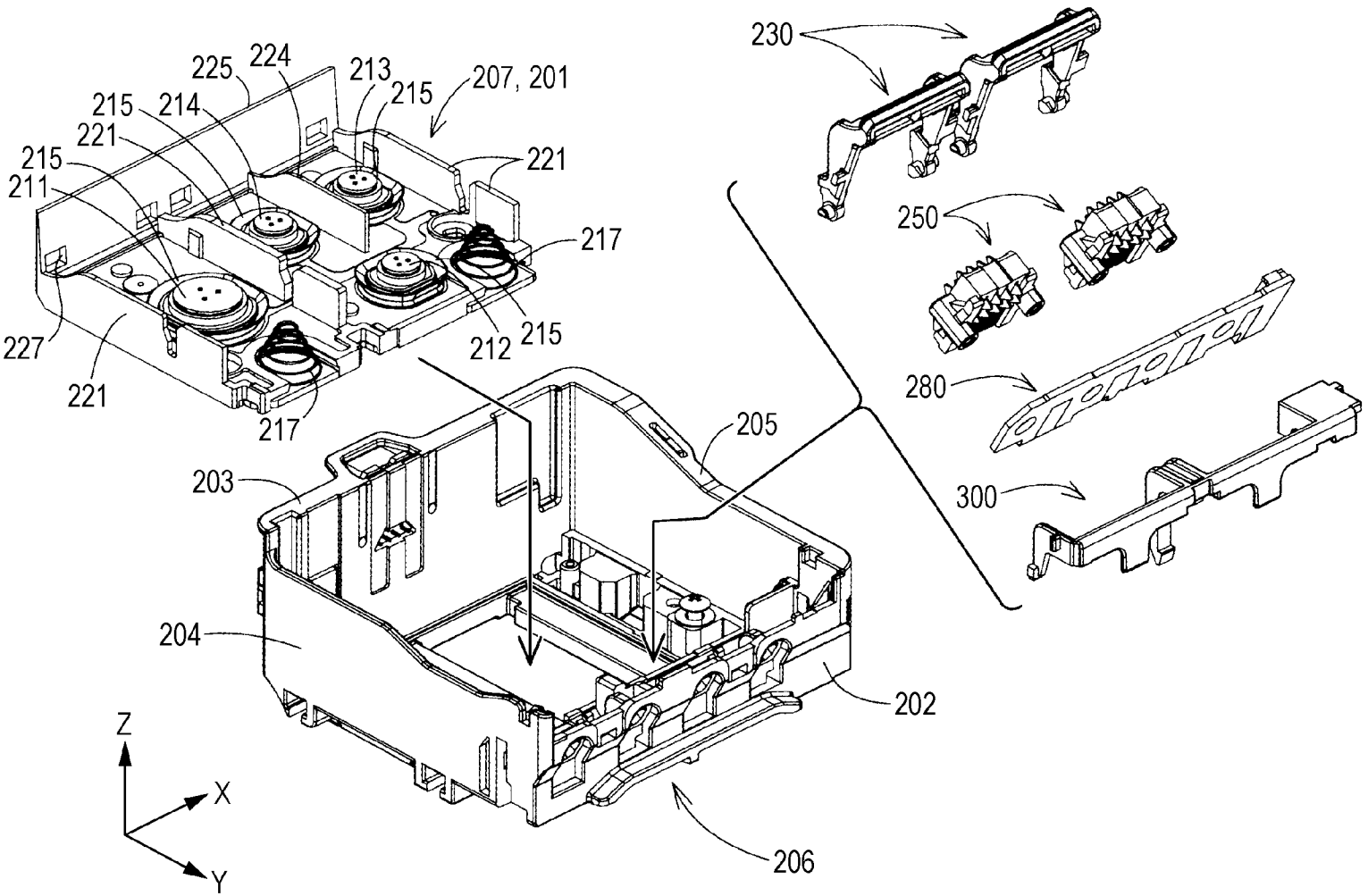
FIG. 7 is an exploded perspective view of the holder unit.

A schematic configuration of the holder unit 200 will be described with reference to FIGS. 4 to 7. FIG. 4 is an upper part perspective view of a holder unit 200 when being viewed from above on the front surface side. FIG. 5 is an upper part perspective view of the holder unit 200 when being viewed from the rear surface side. FIG. 6 is a lower part perspective view of the holder unit 200. FIG. 7 is an exploded perspective view of the holder unit 200. The holder unit 200 includes a cartridge accommodating chamber 210 in which the first and second cartridges 100*a* and 100*b* are accommodated (FIGS. 4 and 5). The cartridge accommodating chamber 210 is surrounded with five wall portions 201 to 205 (FIGS. 4 to 6).

A base wall portion 201 configures a base of the cartridge accommodating chamber 210 on which the first and second cartridges 100*a* and 100*b* are placed. A front face wall portion 202 and a rear face wall portion 203 extend from an end portion on the front side, and an end portion on the rear face side of the base wall portion 201 toward an approximately vertical higher part, respectively, and configure a front face and a rear face of the cartridge accommodating chamber 210. A first side face wall portion 204 and a second side face wall portion 205 extend from a left end portion and a right end portion of the base wall portion 201 toward an approximately vertical higher part, respectively, and configure a left side face and a right side face of the cartridge accommodating chamber 210.

According to the embodiment, the front face wall portion 202, the rear face wall portion 203, the first side face wall portion 204, and the second side face wall portion 205 are configured using each side wall of an outer peripheral wall member 206 which is formed using integral molding, and has an approximately square cylinder shape (FIG. 7). In addition, the base wall portion 201 is formed as a separate body from the outer peripheral wall member 206, and is configured using a plate member 207 which is arranged at a base side opening portion of the outer peripheral wall member 206. Two lever members 230, two connector units 250, a wiring board 280, and a cover member 300 are attached to the front face wall portion 202 of the outer peripheral wall member 206 by being integrally combined.

The two lever members 230 have the same configuration, respectively, and are arranged in a line in the arrow X direction. The lever members 230 are provided so as to correspond to the respective first and second cartridges 100*a* and 100*b* one by one. Each lever member 230 is attached to the front face wall portion 202 so as to rotatably move in the arrow Y direction. The lever member 230 functions as a retaining portion which retains the cartridge 100 due to the rotatable movement (which will be described later). In addition, in the specification, "retains" means an action of limiting a movement of a target in a predetermined direction by being in contact with the target directly or indirectly from the predetermined direction.

The connector unit 250 and the wiring board 280 configure the electrical connection unit in the holder unit 200. The two connector units 250 have the same configuration, respectively, and are arranged on the lower part of the two lever members 230 one by one. The connector unit 250 is in electrical contact with a circuit board (which will be described later) of the cartridge 100. The wiring board 280 (FIG. 7) is arranged between the two connector units 250 and the front face wall portion 202. The wiring board 280 mediates an electrical connection between the connector unit 250 and the wiring cable 30.

The cover member 300 configures a part of the front face wall portion 202 of the holder unit 200, and integrally arranges the lever member 230, the connector unit 250, and the wiring board 280 at the front face wall portion 202 side. Detailed configuration and function of the lever member 230, the connector unit 250, and the wiring board 280 will be described later.

The above described print head 190 is attached to the lower face of the base wall portion 201 (FIG. 6). Ink introducing ports 211 to 214 are provided on the upper face of base wall portion 201 (FIGS. 4 and 5). An ink supply opening (which will be described later) of each of cartridges 100*a* and 100*b* is connected to the ink introducing ports 211 to 214. Ink from each of cartridges 100*a* and 100*b* is introduced to an ink flow path of the print head 190 (FIG. 3) through the ink introducing ports 211 to 214. A seal portion 215 is provided at the outer periphery of each of ink introducing ports 211 to 214. The seal portion 215 suppresses penetration of outside air into the ink flow path, and suppresses leakage of ink to the outside.

An urging mechanism 217 is provided in the base wall portion 201. The urging mechanism 217 urges each of cartridges 100*a* and 100*b* which is placed on the base wall portion 201 in a direction which is separated from the holder unit 200 (higher part). According to the embodiment, the urging mechanism 217 is configured using a helical spring. Due to the urging mechanism 217, a fixing property of each of cartridges 100*a* and 100*b* in the holder unit 200 is increased, and an operability when detaching thereof is increased.

A first sub-wall portion 221 and a second sub-wall portion 224 which are parallel to the first side face wall portion 204 and the second side face wall portion 205, and of which heights from the base wall portion 201 are low are provided in the base wall portion 201. The first sub-wall portion 221 is provided at a position neighboring the first side face wall portion 204, a position neighboring the second side face wall portion 205, and a boundary of arranging regions of the first and second cartridges 100*a* and 100*b*. The second sub-wall portion 224 is provided at a boundary of second and third ink chambers (which will be described later) in a region in which the second cartridge 100*b* is arranged. The first sub-wall portion 221 functions as a positioning unit of the first and second cartridges 100*a* and 100*b*. In addition, the first sub-wall portion 221 and the second sub-wall portion 224 function as collision prevention units which prevent corner portions of the first and second cartridges 100*a* and 100*b* from colliding with the ink introducing ports 211 to 214.

A third sub-wall portion 225 which extends in parallel to the rear face wall portion 203 is provided at a position neighboring the rear face wall portion 203 in the base wall portion 201. A plurality of fitting holes 227 are arranged in the arrow X direction at a lower end of the third sub-wall portion 225. When mounting the first and second cartridges 100*a* and 100*b*, a plurality of protrusion portions (which will be described later) which are provided at lower ends of each of the first and second cartridges 100*a* and 100*b* are inserted into each fitting hole 227.

Hereinafter, configurations of the lever member 230, the connector unit 250, and the wiring board 280 will be described in order with reference to any of FIGS. 8 to 14.

(ii) Configuration of Lever Member

Figure 8:
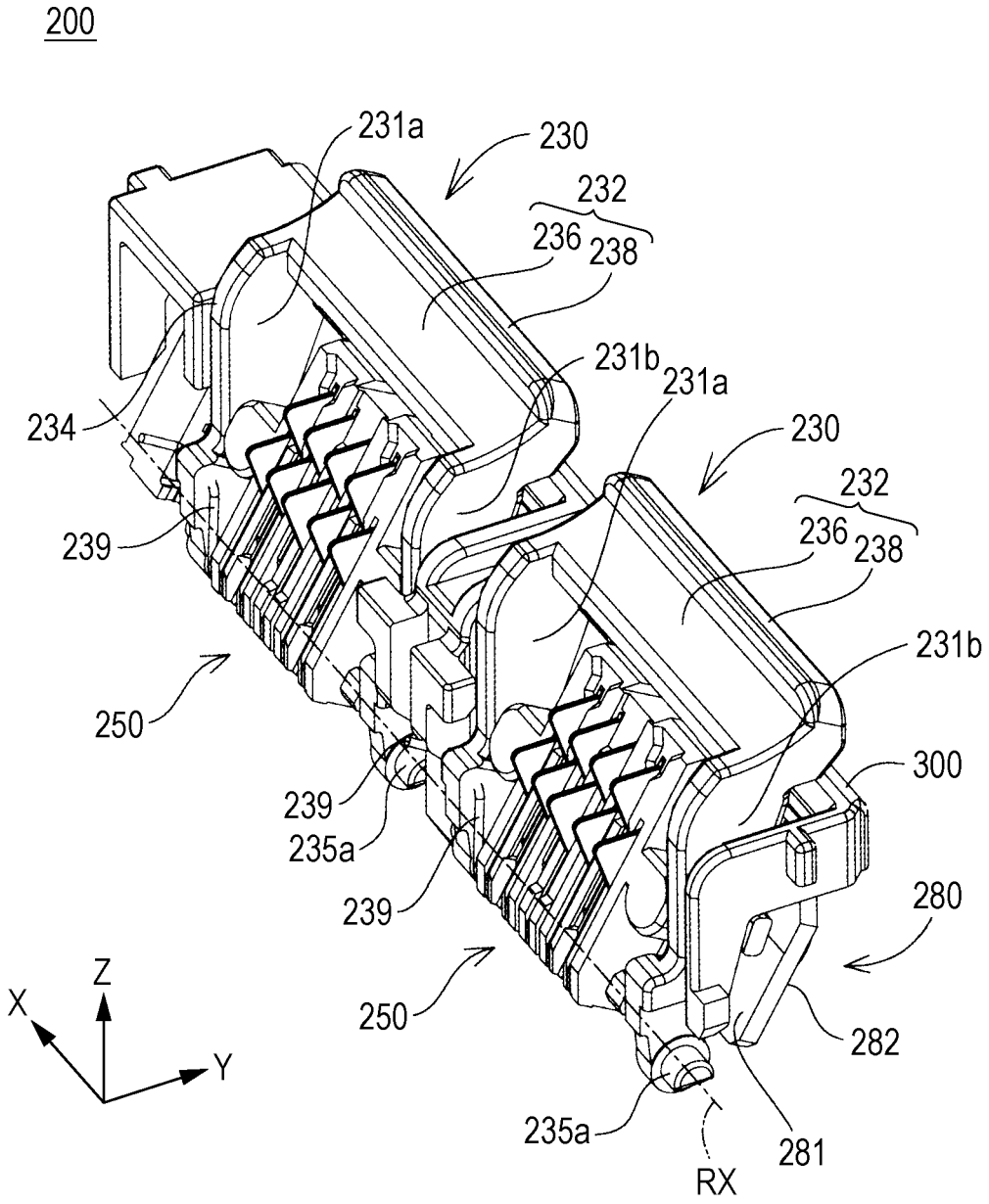
FIG. 8 is an upper part perspective view when a lever member, a connector unit, and a wiring board which are in a state of being attached to a front face wall portion of the holder unit are viewed from the rear surface side.
Figure 9:
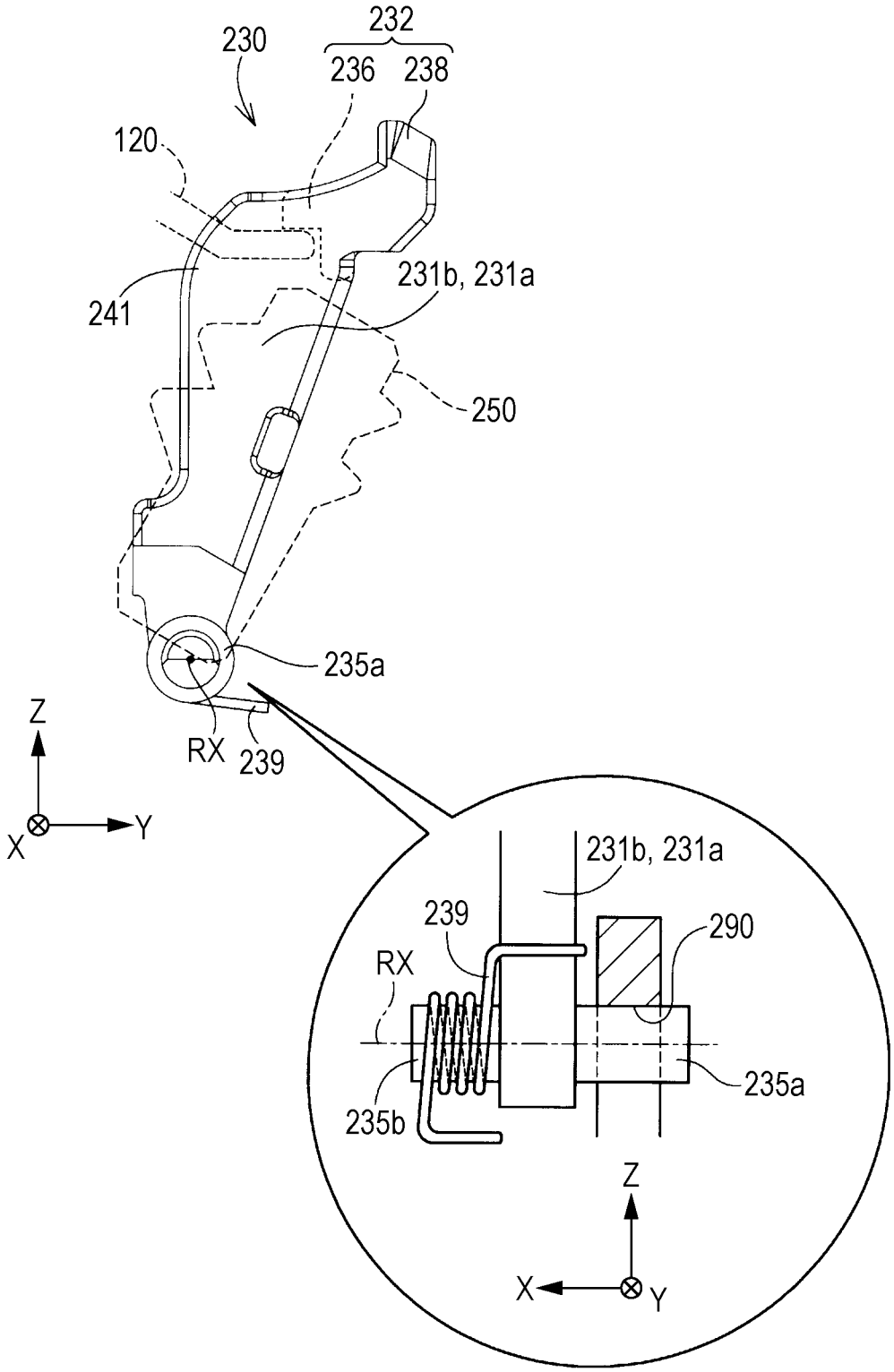
FIG. 9 is a schematic diagram which describes a configuration of the lever unit.

A configuration of the lever member 230 will be described with reference to FIGS. 8 and 9. FIG. 8 is an upper part perspective view when the lever member 230, the connector unit 250, and the wiring board 280 which are in a state of being attached to the front face wall portion 202 of the holder unit 200 are viewed from the rear surface side. FIG. 9 is a side view of the lever member 230 when being viewed along the arrow X direction. In FIGS. 8 and 9, a rotation shaft RX of the lever member 230 is illustrated, respectively. In FIG. 9, an arranging region of the connector unit 250 in the holder unit 200, and an arranging region of a main engaging portion 120 of each of cartridges 100*a* and 100*b* when the first and second cartridges 100*a* and 100*b* are mounted on the holder unit 200, and are denoted by a dashed line. In addition, in FIG. 9, a mounting structure of the lever member 230 at an end portion of a second leg portion 231*b* of the lever member 230 is illustrated by being extracted in a balloon.

The lever member 230 is in a rectangular shape which is open toward the lower part, and includes a first and second leg portions 231*a* and 231*b*, and a bridge portion 232. The first and second leg portions 231*a* and 231*b* are stretched in the arrow Z direction from the base wall portion 201 in the holder unit 200. The first and second leg portions 231*a* and 231*b* have approximately the same shape, and are arranged in parallel in the arrow X direction. The bridge portion 232 is a portion which is stretched in the arrow X direction, and is built as a bridge at higher ends of the first and second leg portions 231*a* and 231*b*.

A first convex portion 235*a* which protrudes toward the outside, and a second convex portion 235*b* which protrudes toward the inside, respectively, in the arrow X direction are provided at the lower end of each of the leg portions 231*a* and 231*b* of the lever member 230. The lever member 230 is attached when each first convex portion 235*a* of each of the leg portions 231*a* and 231*b* is fitted into a fitting hole 290 which is provided at the lower end of the front face wall portion 202 (in balloon in FIG. 9). In this manner, the lever member 230 can rotatably move in an anterior-posterior direction by setting a central axis of each first convex portion 235*a* as the rotation shaft RX.

An urging mechanism 239 is provided at the lower end of each of the leg portions 231*a* and 231*b*. According to the embodiment, the urging mechanism 239 is configured of a torsion spring, and is attached to the second convex portion 235*b* of each of the leg portions 231*a* and 231*b*. The lever member 230 is retained so as to stop at a predetermined rotation angle in a state of being urged toward the cartridge accommodating chamber 210 due to the urging mechanism 239. The lever member 230 rotatably moves due to an external force in a direction separated away from the cartridge accommodating chamber 210, and then returns to an initial position due to the urging force of the urging mechanism 239 when the external force is released.

The bridge portion 232 includes a abutting portion 236, and an operation portion 238. The contact unit 236 is located at an end portion on the opposite of arrow Y (the cartridge accommodating chamber 210 side) in the bridge portion 232. In the abutting portion 236, at least a part of the lower side of an end portion on the cartridge accommodating chamber 210 side comes into contact with at least a part of the main engaging portion 120 (which will be described later) of the cartridge 100. Due to the contact of the abutting portion 236, a movement of the cartridge 100 in a direction separated from the holder unit 200 (arrow Z direction) is limited.

The operation portion 238 is located at an end portion on the arrow Y side (front side) in the bridge portion 232, and is a portion which is bent toward the upper part from the abutting portion 236. A user is able to rotatably move the lever member 230 easily toward the front side by hooking a finger tip into the operation portion 238, and pulling the operation portion. In addition, the operation portion 238 is formed so as not to protrude from the front face wall portion 202 in the arrow Y direction in the holder unit 200.

The connector unit 250 is arranged between the first and second leg portions 231*a* and 231*b* of the lever member 230. The connector unit 250 is fixed to the front face wall portion 202 of the holder unit 200 independently from the lever member 230 in a state of having an angle of inclination (for example, 10 degrees to 45 degrees with respect to arrow Z direction) corresponding to a circuit board (which will be described later) of the cartridge 100. In this manner, in the holder unit 200 according to the embodiment, the lever member 230 and the connector unit 250 are arranged so as not to interfere with each other.

(iii) Configuration of Connector Unit

Figure 10:
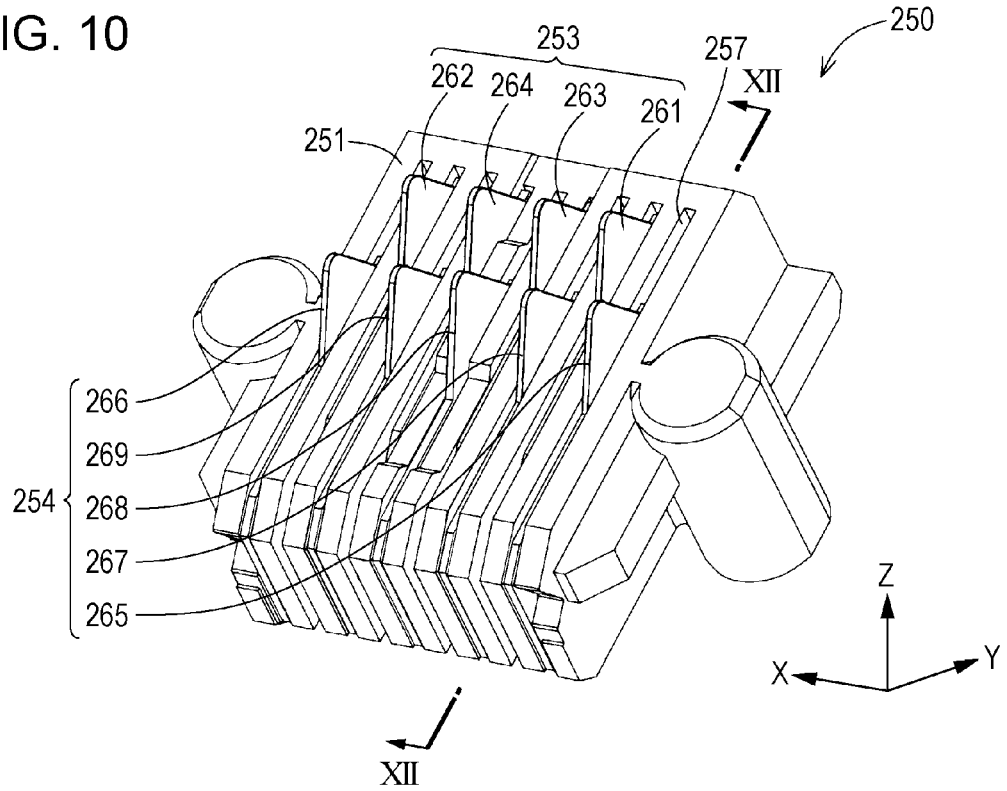
FIG. 10 is a schematic perspective view which illustrates a face on the rear side of the connector unit.
Figure 11:
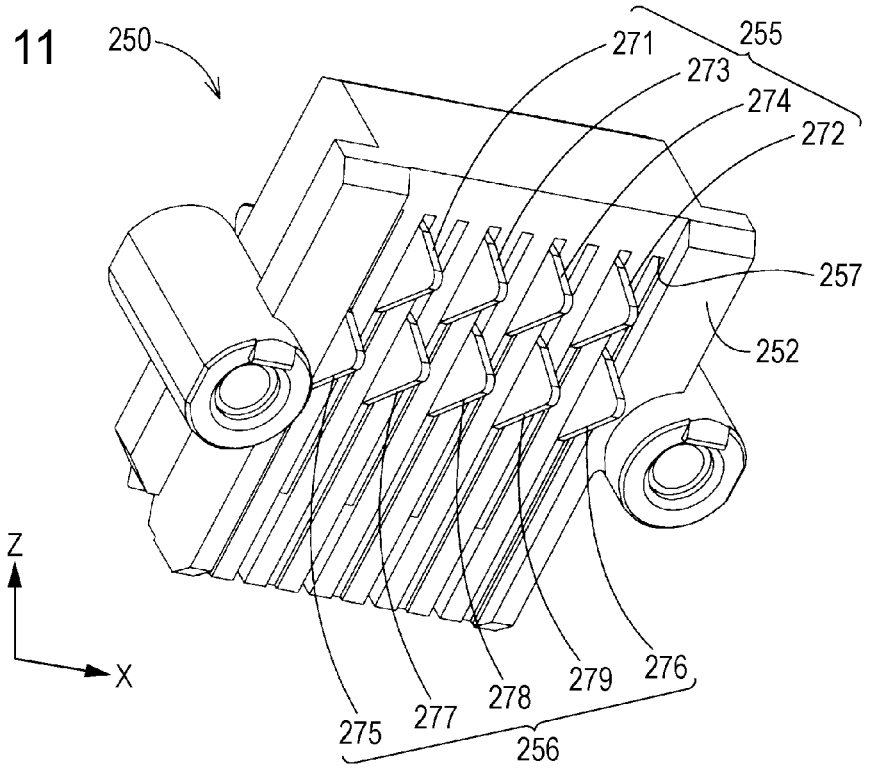
FIG. 11 is a schematic perspective view which illustrates a face on the front side of the connector unit.
Figure 12:
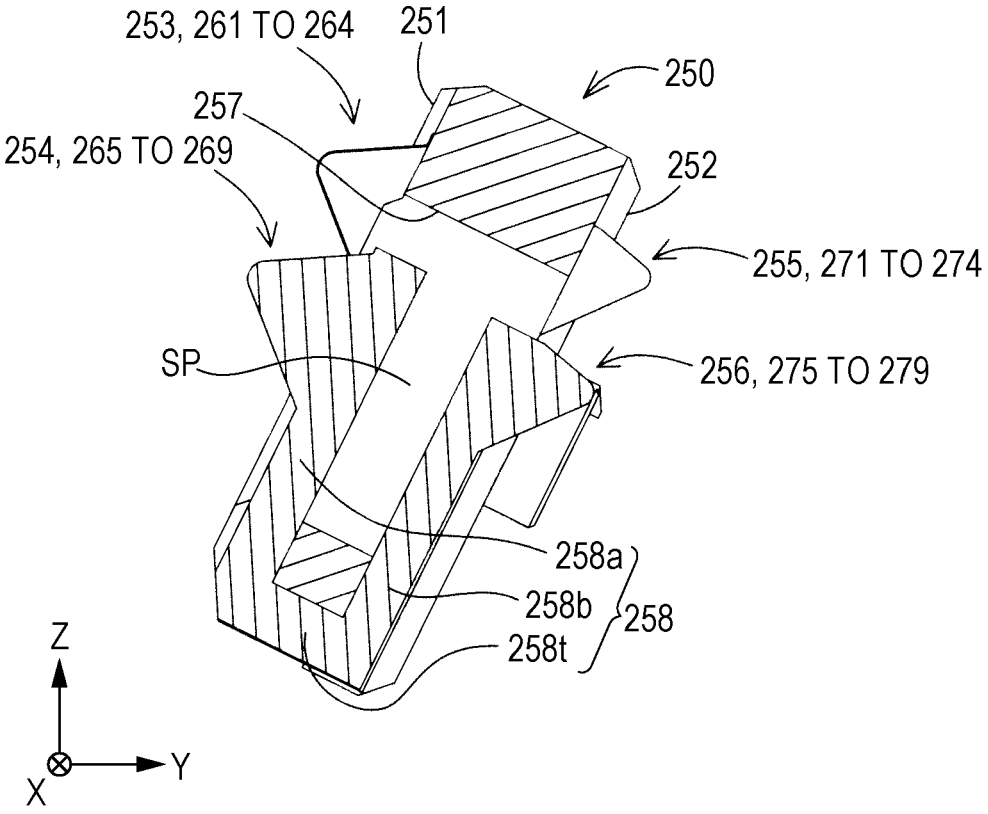
FIG. 12 is a schematic cross-sectional view of the connector unit.

A configuration of the connector unit 250 will be described with reference to FIGS. 10 to 12. FIG. 10 is a schematic perspective view which illustrates a face on the rear side of the connector unit 250. FIG. 11 is a schematic perspective view which illustrates a face on the front side of the connector unit 250. FIG. 12 is a schematic cross-sectional view of the connector unit 250 which is cut along line XII-XII in FIG. 10. The connector unit 250 has an approximately flat plate shape, and includes a face 251 on the rear side, and a face 252 on the front side. Hereinafter, the face 251 on the rear side is referred to as the "terminal portion front surface 251", and the face 252 on the front side is referred to as the "terminal portion rear surface 252".

The terminal portion front surface 251 (FIG. 10) is a face which faces the cartridge accommodating chamber 210 side. An upper terminal portion 253, and a lower terminal portion 254 are provided in the terminal portion front surface 251. The upper terminal portion 253 includes a plurality of terminals 261 to 264 which are arranged in the arrow X direction. The lower terminal portion 254 is located at a lower part of the upper terminal portion 253, and includes a plurality of terminals 265 to 269 which are arranged in the arrow X direction.

Each of the terminals 261 to 269 according to the embodiment is configured of an approximately triangular metal plate which protrudes from a plurality of slits 257 which extend in parallel in the arrow Z direction in the terminal portion front surface 251. Each of the terminals 261 to 269 is arranged in parallel so that the thickness direction thereof matches the arrow X direction. Each of the terminals 261 to 269 is in direct contact with one terminal corresponding to the circuit board (which will be described later) of the cartridge 100 at an apex thereof when the cartridge 100 is mounted on the holder unit 200.

The first and second terminals 261 and 262 are respectively arranged at both ends in the arrow X direction in the upper terminal portion 253. The third and fourth terminals 263 and 264 are arranged in order in the arrow X direction between the first and second terminals 261 and 262. The fifth and sixth terminals 265 and 266 are respectively arranged at both ends in the arrow X direction in the lower terminal portion 254. The seventh, eighth and ninth terminals 267, 268, and 269 are arranged in order in the arrow X direction between the fifth and sixth terminals 265 and 266.

The first and second terminals 261 and 262 are used when detecting mounting of the cartridge 100 with respect to the holder unit 200 by the printing apparatus 10 (details will be described later). Since the first and second terminals 261 and 262 are arranged at both ends in the arrow X direction in which the number of neighboring terminals is small, an occurrence of being short circuited with another terminal is suppressed. In addition, the first and second terminals 261 and 262 are protected by an extension unit 234 of the first and second leg portions 231*a* and 231*b* of the lever member 230, and an occurrence of contact failure with a terminal on the cartridge 100 side is suppressed.

The third terminal 263 is a ground electrode, and supplies a reference potential of a low potential to a storage device (which will be described later) of the cartridge 100. The fourth terminal 264 is a power terminal, and supplies a power potential of high potential to the storage device of the cartridge 100. The fifth and sixth terminals 265 and 266 are used when detecting mounting of the cartridge 100 with respect to the holder unit 200 by the printing apparatus 10, similarly to the first and second terminals 261 and 262.

The seventh terminal 267 is a reset terminal for supplying a reset signal to the storage device of the cartridge 100. The eighth terminal 268 is a clock terminal for supplying a clock signal to the storage device of the cartridge 100 from the printing apparatus 10. The ninth terminal 269 is a data terminal for performing exchanging of a data signal between the storage device of the cartridge 100 and the ninth terminal 269. The printing apparatus 10 performs exchanging of data between the storage device (which will be described later) of the cartridge 100 and the printing apparatus using a serial transmission through the ninth terminal 269 based on a clock signal which is supplied through the eighth terminal 268. In addition, arrangement configurations of the third terminal 263, the fourth terminal 264, the seventh terminal 267, the eighth terminal 268, and the ninth terminal 269 are not limited to the above described configuration example, and can be appropriately changed.

The terminal portion rear surface 252 (FIG. 11) is a face on a side facing the wiring board 280 in the holder unit 200. An upper terminal portion 255 and a lower terminal portion 256 are provided on the terminal portion rear surface 252, similarly to the terminal portion front surface 251. The upper terminal portion 255 includes a plurality of terminals 271 to 274 which are arranged in the arrow X direction. The lower terminal portion 256 is located at the lower part of the upper terminal portion 255, and includes a plurality of terminals 275 to 279 which are arranged in the arrow X direction. In each of the terminals 271 to 275 of the terminal portion rear surface 252, and each of the terminals 261 to 269 of the terminal portion front surface 251, the same end numbers of reference numerals correspond to each other, and are electrically connected.

Each of the terminals 271 to 279 of the terminal portion rear surface 252 are configured of an approximately triangular metal plate which protrudes from the slit 257 of the terminal portion rear surface 252, similarly to each of the terminals 261 to 269 of the terminal portion front surface 251. Each of the terminals 271 to 279 is in contact with one corresponding electrode of a plurality of electrodes (which will be described later) which configure an electrode portion of the wiring board 280, and is electrically connected.

In each of the terminals 261 to 269 of the terminal portion front surface 251, and in each of the terminals 271 to 279 of the terminal portion rear surface 252, terminals which are at corresponding arranging positions in each of faces 251 and 252 are connected through a plate-shaped conductive member 258 (FIG. 12). The plate-shaped conductive member 258 is configured of a plate-shaped metallic member which is elastically deformed. The plate-shaped conductive member 258 includes two extension portions 258*a* and 258*b*, and a folded portion 258*t*. The two extension portions 258*a* and 258*b* are portions which extend toward the lower end from each of the terminals 261 to 269, and 271 to 279, respectively, in the respective terminal portion front surface 251 and the terminal portion rear surface 252. The folded portion 258*t* is a portion at which each of extension portions 258*a* and 258*b* are connected by being folded at the lower end of the connector unit 250.

The plate-shaped conductive member 258 is fixed to the connector unit 250 in the folded portion 258*t* at the lower end, and a space SP is formed between the extension portions 258*a* and 258*b* in each of the terminal portion front surface 251 and the terminal portion rear surface 252. The plate-shaped conductive member 258 functions as a flat spring which has an elastic force in the thickness direction of the connector unit 250 due to the configuration, and each of the terminals 261 to 269, and 271 to 279 are urged along respective protrusion directions (thickness direction of connector unit 250) by the plate-shaped conductive member 258. Due to the urging, accessibility of each of the terminals 261 to 269, and 271 to 279 of the connector unit 250 with respect to corresponding terminal is increased.

(iv) Configuration of Wiring Board

Figure 13:
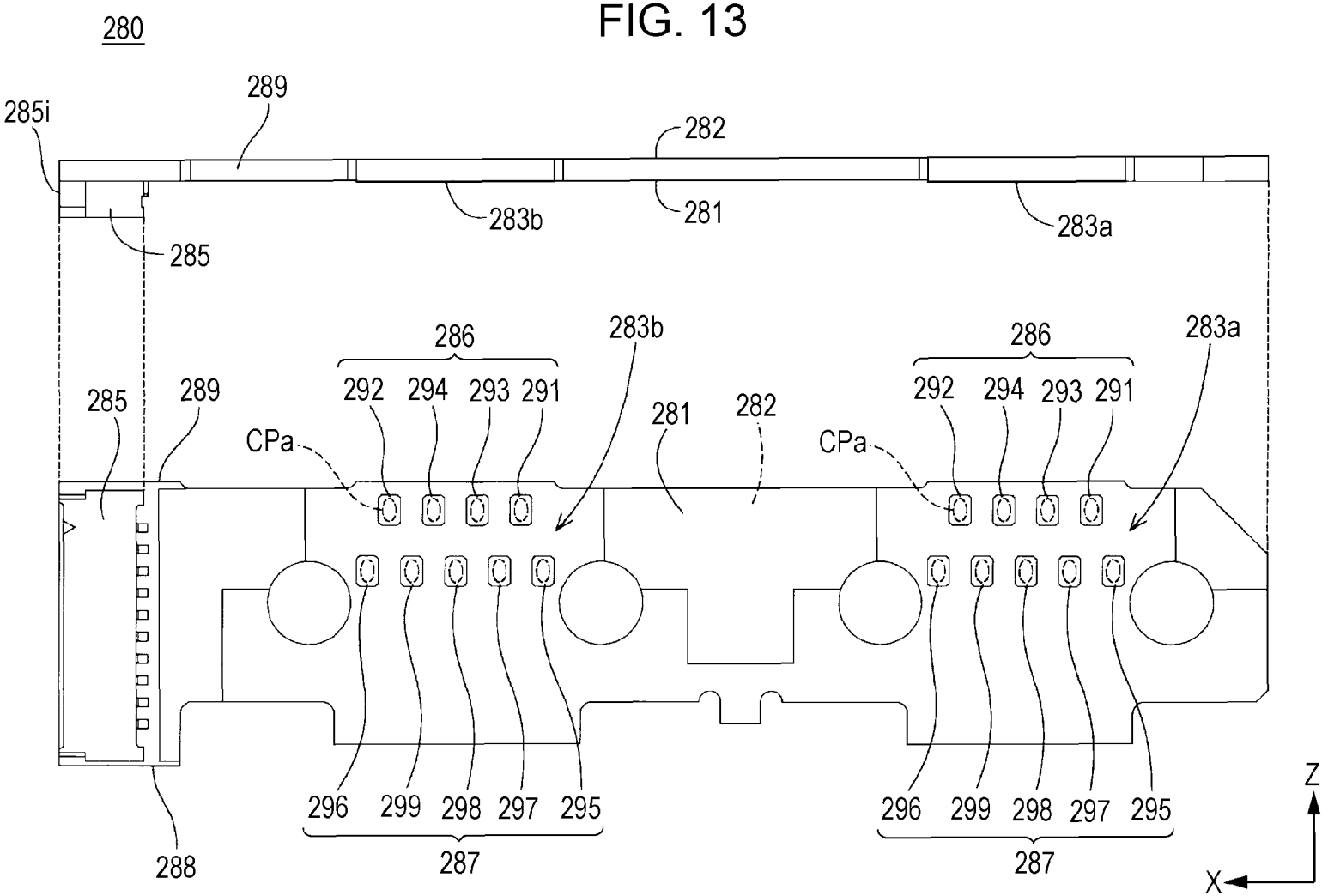
FIG. 13 is a schematic diagram in which an upper side end face of the wiring board and a face on the side facing the connector unit are illustrated by corresponding to each other.
Figure 14:
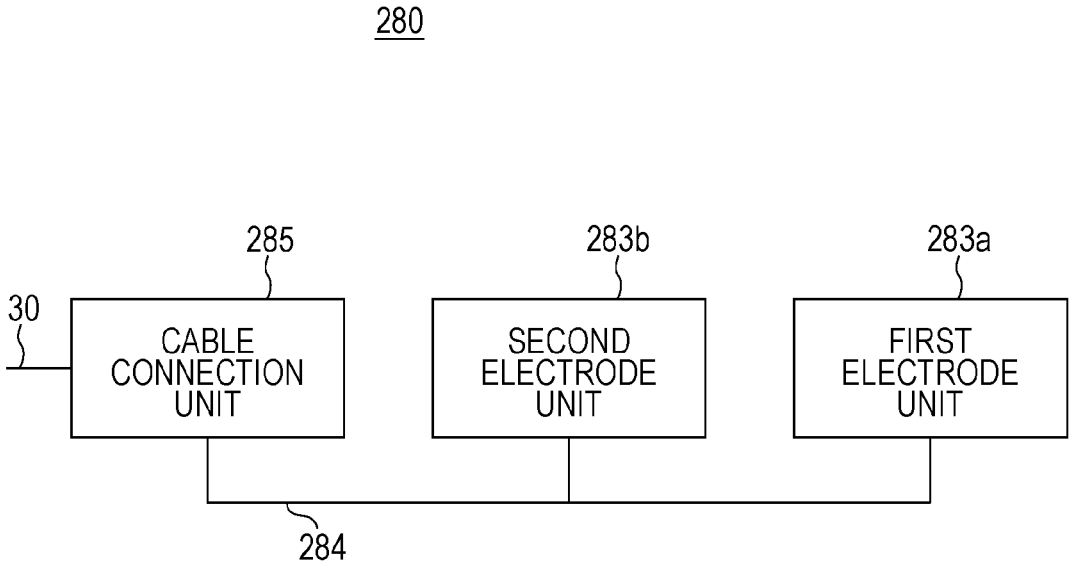
FIG. 14 is a schematic diagram which describes a connection configuration of wiring in the wiring board.

A configuration of the wiring board 280 will be described with references to FIGS. 13 and 14. FIG. 13 is a schematic diagram in which an upper side end face of the wiring board 280 and a face on the side facing the connector unit 250 are illustrated by corresponding to each other. In FIG. 13, a contact portion CPa in each of electrodes 291 to 299 is denoted by a dashed line. FIG. 14 is a schematic diagram which describes a connection configuration of wiring in the wiring board 280.

The wiring board 280 corresponds to a wiring base. According to the embodiment, the wiring board 280 has approximately a rectangular shape, and a length in the arrow X direction is larger than a length (width) in the arrow Z direction (FIG. 13). According to the embodiment the wiring board 280 is configured as a multilayer substrate which is formed by layering polycarbonate substrates. In addition, the wiring board 280 may be configured as flexible printed circuits (FPC) which are formed based on a flexible resin film. In this manner, it is possible to make the wiring board 280 thinner and lighter.

The wiring board 280 includes a first face 281 which faces the connector unit 250, and a second face 282 on the side opposite thereto. First and second electrode portions 283*a* and 283*b* which are in electrical contact with the connector unit 250 are provided on the first face 281, that is, the first face 281 corresponds to a base face. The first and second electrode portions 283*a* and 283*b* are arranged in order in the arrow X direction at a position close to an upper end 289 compared to a lower end 288. When the cartridge 100 is mounted on the holder unit 200, the first electrode portion 283*a* is electrically connected to the first cartridge 100*a*, and the second electrode portion 283*b* is electrically connected to the second cartridge 100*b*.

The first and second electrode portions 283*a* and 283*b* have the same configuration, and include an upper electrode line 286 and a lower electrode line 287, respectively. The upper electrode line 286 includes a plurality of electrodes 291 to 294 which are arranged in the arrow X direction. In the upper electrode line 286, the first and second electrodes 291 and 292 are arranged at both ends in the arrow X direction in the upper electrode line 286, respectively. The third and fourth electrodes 293 and 294 are arranged in order in the arrow X direction between the first and second electrodes 291 and 292.

The lower electrode line 287 is located at the lower part of the upper electrode line 286, and includes a plurality of electrodes 295 to 299 which are arranged in the arrow X direction. In the lower electrode line 287, the fifth and sixth electrodes 295 and 296 are arranged at both ends in the arrow X direction in the lower electrode line 287, respectively. The seventh, eighth, and ninth electrodes 297, 298, and 299 are arranged in order in the arrow X direction between the fifth and sixth electrodes 295 and 296.

Each of the electrodes 291 to 299 of the wiring board 280 is in contact with one corresponding electrode of each of the terminals 271 to 279 which is provided on the terminal portion rear surface 252 (FIG. 11) of the connector unit 250. In each of electrodes 291 to 299 of the wiring board 280, and each of the terminals 271 to 279 of the connector unit 250, the same end numbers of reference numerals correspond to each other, and are in contact with each other.

A cable connection portion 285 is further provided on the first face 281 side of the wiring board 280. The cable connection portion 285 is arranged at an end portion on the second electrode portion 283*b* side in the arrow X direction on the first face 281. According to the embodiment, the cable connection portion 285 is an approximately rectangular parallelepiped mounting component, and protrudes in the thickness direction of the wiring board 280 on the first face 281. The cable connection portion 285 includes a connection port 285*i* which opens to a direction opposite to the arrow X direction.

The wiring board 280 is electrically connected to the wiring cable 30 when a terminal of the wiring cable 30 (FIG. 3) is fitted into the connection port 285*i* of the cable connection portion 285 by being inserted in a direction opposite to the arrow X direction. According to the embodiment, the wiring cable 30 is detachably configured with respect to the cable connection portion 285. In this manner, it is possible to perform easy attachment of the carriage 27 with respect to the printing apparatus 10, and to perform easy detachment of the carriage 27 from the printing apparatus 10.

The wiring board 280 includes a wiring group 284 which electrically connects the respective first and second electrode portions 283*a* and 283*b* with respect to the cable connection portion 285 in parallel on the inside thereof (FIG. 14). Wiring or ground wiring which transmits a data signal, a clock signal, and a reset signal are included in the wiring group 284. Since the first and second electrode portions 283*a* and 283*b* are wired or connected, outputs thereof are set to be open collector output.

With such a wiring configuration, it is possible to omit mounting of an element such as ASIC, or the like, for allocating electrical signals to the first and second electrode portions 283*a* and 283*b*, respectively, on the wiring board 280. For this reason, it is possible to make the wiring board 280 small and light. In addition, in the wiring board 280, wiring for connecting the cable connection portion 285, and the first and second electrode portions 283*a* and 283*b*, respectively, and wiring for connecting between the first and second electrode portions 283*a* and 283*b* may be provided in the wiring board 280 in addition to the wiring group 284. The wiring may be used when transmitting an electrical signal for detecting mounting of the cartridge 100.

The wiring board 280 is arranged so as to face a fourth wall portion 104 of both of the first and second cartridges 100*a* and 100*b* by interposing the connector unit 250 therebetween in the holder unit 200 (FIGS. 7 and 8). In the holder unit 200, the lower end 288 of the wiring board 280 is located at a position of approximately the same height as the lower end of the lever member 230 and the lower end of the connector unit 250 (FIG. 8).

The wiring board 280 is arranged with an angle of inclination with respect to the arrow Z direction so that the first face 281 is approximately parallel to the terminal portion rear surface 252 of the connector unit 250. According to the embodiment, the wiring board 280 is arranged so that an angle of a first face S1 in the arrow Z direction is 45 degrees or less, and is more preferably 30 degrees or less. In this manner, it is possible to prevent an arranging region of the wiring board 280 from being large in the arrow Y direction. In addition, it is possible to catch a component of a pressing force in a direction opposite to the arrow Z direction which occurs when mounting the cartridge 100, and to increase an electrical connection property between the connector unit 250 and the wiring board 280.

Configuration of First Cartridge

Figure 15:
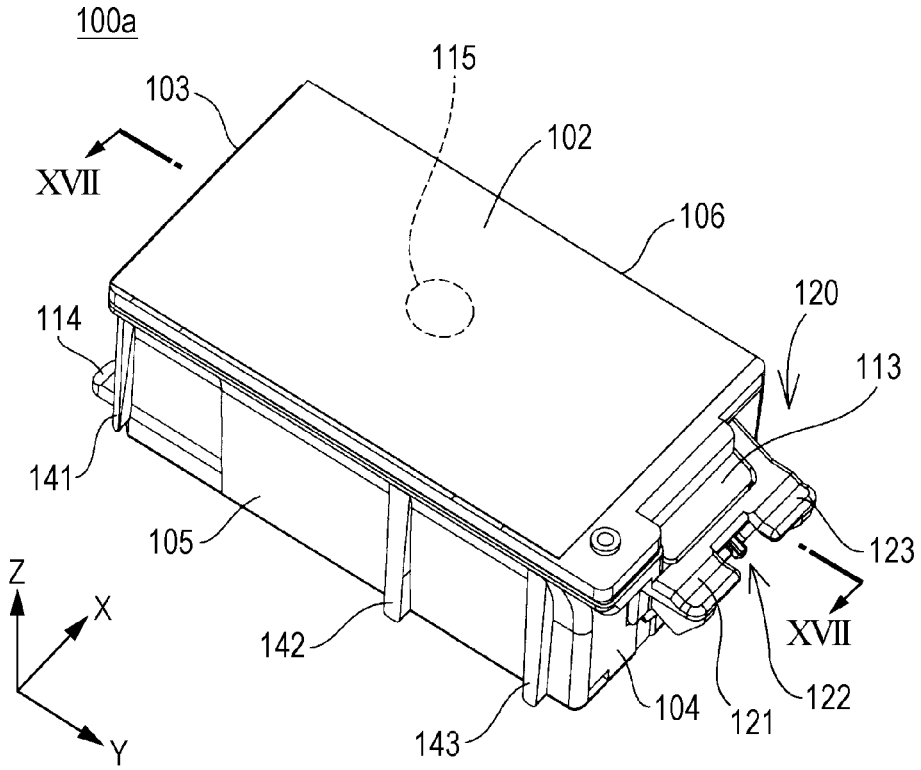
FIG. 15 is an upper part perspective view of a first cartridge.
Figure 16:
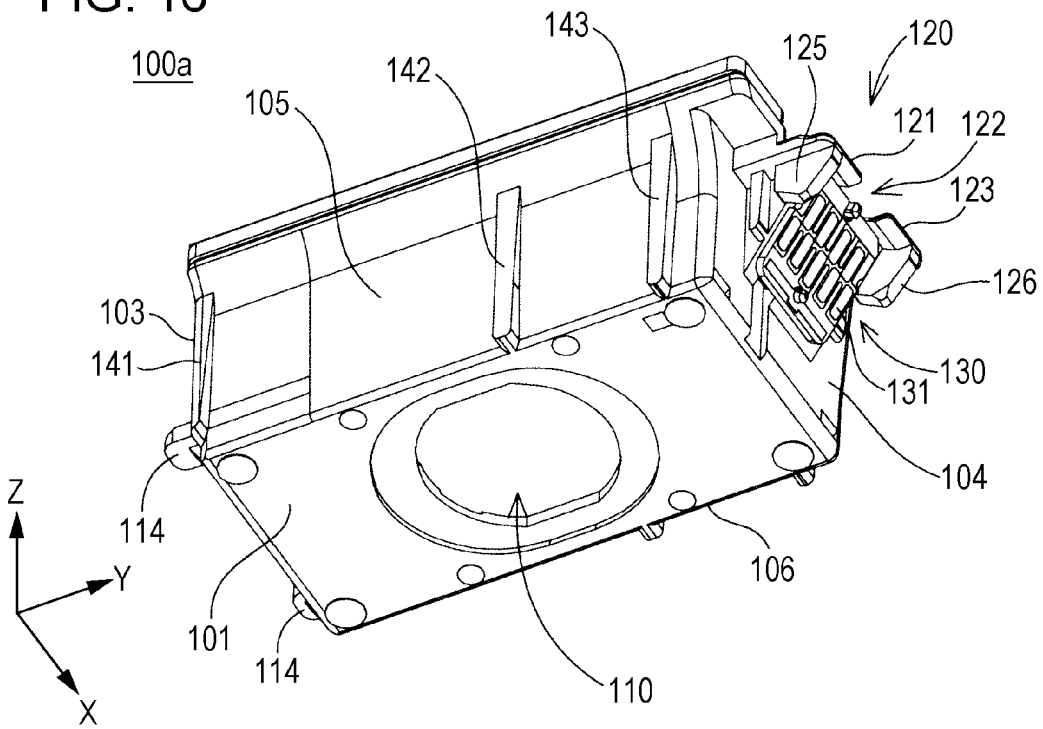
FIG. 16 is a lower part perspective view of the first cartridge.
Figure 17:
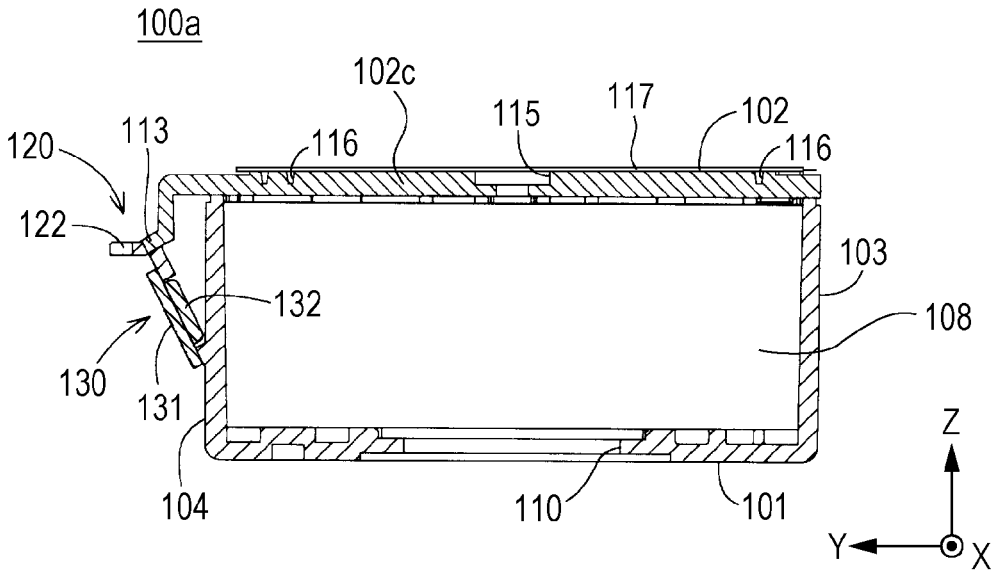
FIG. 17 is a schematic cross-sectional view of the first cartridge.

A configuration of the first cartridge 100*a* will be described in detail with reference to FIGS. 15 to 17. FIG. 15 is an upper part perspective view of the first cartridge 100*a*. FIG. 16 is a lower part perspective view of the first cartridge 100*a*. FIG. 17 is a schematic cross-sectional view of the first cartridge 100*a* which is cut along line XVII-XVII in FIG. 15. In addition, in FIG. 17, a detailed configuration in an ink chamber 108 is not illustrated.

The first cartridge 100*a* includes six wall portions 101 to 106 which configure an exterior unit which surrounds the ink chamber 108 (FIG. 17) for accommodating ink. A first wall portion 101 (FIG. 16) configures a base which faces the base wall portion 201 of the holder unit 200 when the first cartridge is mounted on the holder unit 200. An ink supply opening 110 which communicates with the ink chamber 108 is provided at a center of the first wall portion 101. The ink supply opening 110 is connected to an ink introducing port 211 of the holder unit 200 when the first cartridge 100*a* is mounted on the holder unit 200.

A second wall portion 102 (FIG. 15) is a wall portion which faces the first wall portion 101, and configures a top face of the first cartridge 100*a*. The second wall portion 102 is configured of a lid 102*c* (FIG. 17) which can be separated from a main body of the first cartridge 100*a*. The second wall portion 102 includes an ink filling opening 115 which is a throughhole for filling ink into the ink chamber 108, an air flow path groove 116 for introducing outside air into the ink chamber 108, and a film-shaped seal member 117 which seals those from above. The second wall portion 102 includes an extension portion 113 which extends in the arrow Y direction, and configures a part of the main engaging portion 120 at a center of an end portion which is neighboring a fourth wall portion 104. In the specification, "extending" means extending in succession without an interval.

A third wall portion 103 (FIG. 17) is a wall portion which configures the rear surface of the first cartridge 100*a*, and faces the rear face wall portion 203 of the holder unit 200 when the first cartridge 100*a* is mounted on the holder unit 200 (FIG. 4). A plurality of protrusion portions 114 which protrude in a direction which goes along the arrow Y are provided at the lower end of the third wall portion 103. The plurality of protrusion portions 114 are engaged by being inserted into the fitting hole 227 (FIGS. 4 and 7) which is provided at the lower end of the holder unit 200 on the rear face wall portion 203 side when the first cartridge 100*a* is mounted on the holder unit 200.

The fourth wall portion 104 (FIG. 15) is a wall portion which configures a front face of the first cartridge 100*a*, and faces the front face wall portion 202 (FIG. 5) of the holder unit 200 when the first cartridge 100*a* is mounted on the holder unit 200. The main engaging portion 120 which is retained to the lever member 230 of the holder unit 200 is provided in the fourth wall portion 104. The main engaging portion 120 is provided at a position close to the upper part in the arrow Z direction (position close to second wall portion 102 compared to first wall portion 101), and at approximately a center position in the arrow X direction.

The main engaging portion 120 is formed as a ligulate-shaped eaves portion which extends to the front (arrow Y direction) while slightly descending from the second wall portion 102. The front end portion of the main engaging portion 120 is locally provided with a convex portion 122 at the center, is partitioned by a space which is formed by the convex portion 122, and is separated into a first eaves portion 121, and a second eaves portion 123. When the first eaves portion 121 and the second eaves portion 123 are engaged with the lever member 230 of the holder unit 200, respectively, a top face thereof comes into contact with the lower side of an abutting portion 236 (FIG. 9) of the lever member 230. In addition, the main engaging portion 120 may have a configuration in which the convex portion 122 is not provided.

A circuit board 130 for exchanging an electrical signal between the printing apparatus 10 and the circuit board is arranged on the lower part of the main engaging portion 120. The circuit board 130 is fixed to the fourth wall portion 104 with an angle of inclination of 10 degrees to 45 degrees in the arrow Z direction, for example, so that the front surface including a terminal portion 131 faces the lower part. A first side wall portion 125 and a second side wall portion 126 which are hung down in parallel to the lower part, respectively, are provided on the lower faces of the first eaves portion 121 and the second eaves portion 123 of the main engaging portion 120. The first side wall portion 125 and the second side wall portion 126 protrude to the front from the front surface of the circuit board 130 on both sides of the circuit board 130, and protect the circuit board 130. In addition, the circuit board 130 may not be fixed so as to have the angle of inclination in the arrow Z direction, and a shape thereof may also not be limited to a flat plate shape.

The circuit board 130 includes the terminal portion 131, and a storage device 132 (FIG. 17). The terminal portion 131 includes a plurality of terminals corresponding to the plurality of terminals 261 to 269 (FIG. 10) of the connector unit 250 of the holder unit 200 (which will be described later). The storage device 132 is configured of a rewritable non-volatile memory such as a flash ROM, for example. The storage device 132 stores information related to ink which is accommodated in the first cartridge 100*a*, such as a color, a residual quantity, or the like, in a non-volatile manner.

A fifth wall portion 105 and a sixth wall portion 106 (FIGS. 15 and 16) are wall portions which configure the side faces of the first cartridge 100*a*. Ribs 141, 142, and 143 when extending in the arrow Z direction are provided on the front surfaces of the fifth wall portion 105 and the sixth wall portion 106. In each of ribs 141, 142, and 143, lower ends thereof come into contact with the first sub-wall portion 221 of the holder unit 200 when the first cartridge 100*a* is mounted on the holder unit 200. In this manner, a movement direction and an arranging posture of the first cartridge 100*a* when being mounted on the holder unit 200 are defined.

Figure 18:
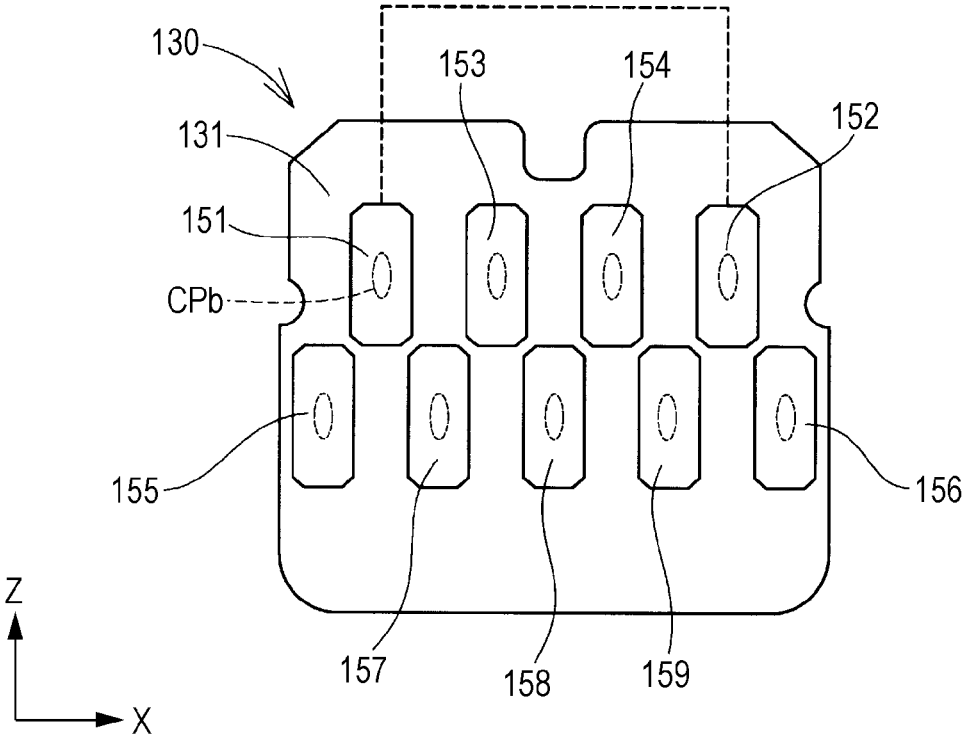
FIG. 18 is a schematic diagram which illustrates an arrangement configuration of a plurality of terminals in a circuit board.

FIG. 18 is a schematic diagram which illustrates an arrangement configuration of a plurality of terminals 151 to 159 in the circuit board 130. In FIG. 18, a position of a contact portion CPb in each of the terminals 151 to 159 is denoted by a dashed line. Each of the terminals 151 to 159 is arranged in an arrangement direction which is parallel to the arrow X direction by being divided into two lines of the upper line and the lower line so as to be electrically connected to corresponding one terminal of the plurality of terminals 261 to 269 (FIG. 10) on the terminal portion front surface 251 of the connector unit 250 of the holder unit 200.

First and second terminals 151 and 152 are respectively arranged at both ends of the upper stage line. Third and fourth terminals 153 and 154 are arranged in the arrow X direction in order between the first and second terminals 151 and 152. Fifth and sixth terminals 155 and 156 are respectively arranged at both ends of the lower stage line. Seventh, eighth, and ninth terminals 157, 158, and 159 are arranged in the arrow X direction in order between the fifth and sixth terminals 155 and 156. The arrangement configuration of each contact portion CPb in the circuit board 130 is the same as the arrangement configuration of each of the terminals 151 to 159. In addition, the configuration of each of the terminals 151 to 159 is not limited to the above described configuration. Each of the terminals 151 to 159 may not have a configuration of being arranged in two lines of an upper line and a lower line, or may not have a configuration in which respective shapes are not the flat plate shape. Each of the terminals 151 to 159 may have a configuration in which the respective contact portions CPb can be electrically connected to at least one corresponding terminal of terminals 263 to 269 of the connector unit 250.

Each of the terminals 151 to 159 is in electrical contact with one corresponding terminal of terminals 261 to 269 of the connector unit 250, and is electrically connected in each of the contact portions CPb. In each of the terminals 151 to 159 of the circuit board 130, and in each of the terminals 261 to 265 of the terminal portion front surface 251 of the connector unit 250, the same end numbers of reference numerals correspond to each other.

The first and second terminals 151 and 152 are configured so that a predetermined voltage change is caused when the first cartridge 100*a* is correctly mounted on the holder unit 200, and is in contact with the first and second terminals 261 and 262 of the connector unit 250. Specifically, the first and second terminals 151 and 152 are mutually short-circuited on the inside of the circuit board 130. The printing apparatus 10 applies a predetermined voltage to the first terminal 151 of the circuit board 130 through the first terminal 261 of the connector unit 250, and detects a change in voltage of the second terminal 152 of the circuit board 130 via the second terminal 262 of the connector unit 250. A function of other terminals 153 to 159 are the same as that of each of corresponding terminals 263 to 269 of the connector unit 250 which is described above.

Configuration of Second Cartridge

Figure 19:
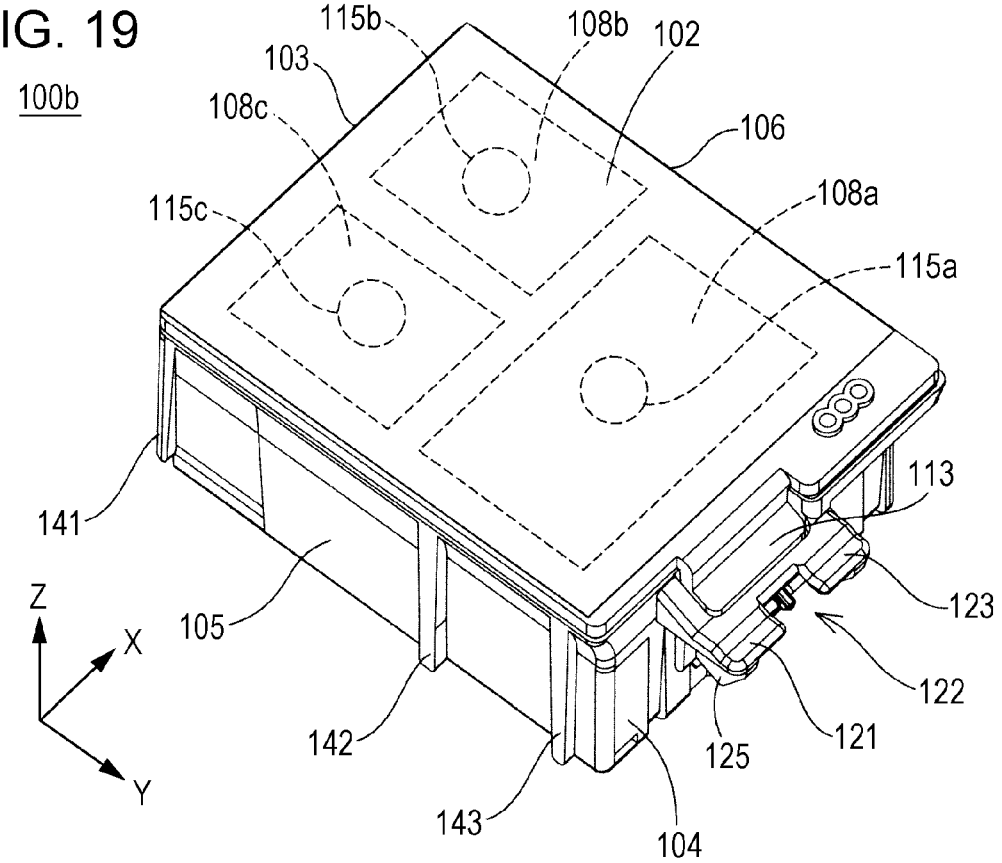
FIG. 19 is an upper part perspective view of a second cartridge.
Figure 20:
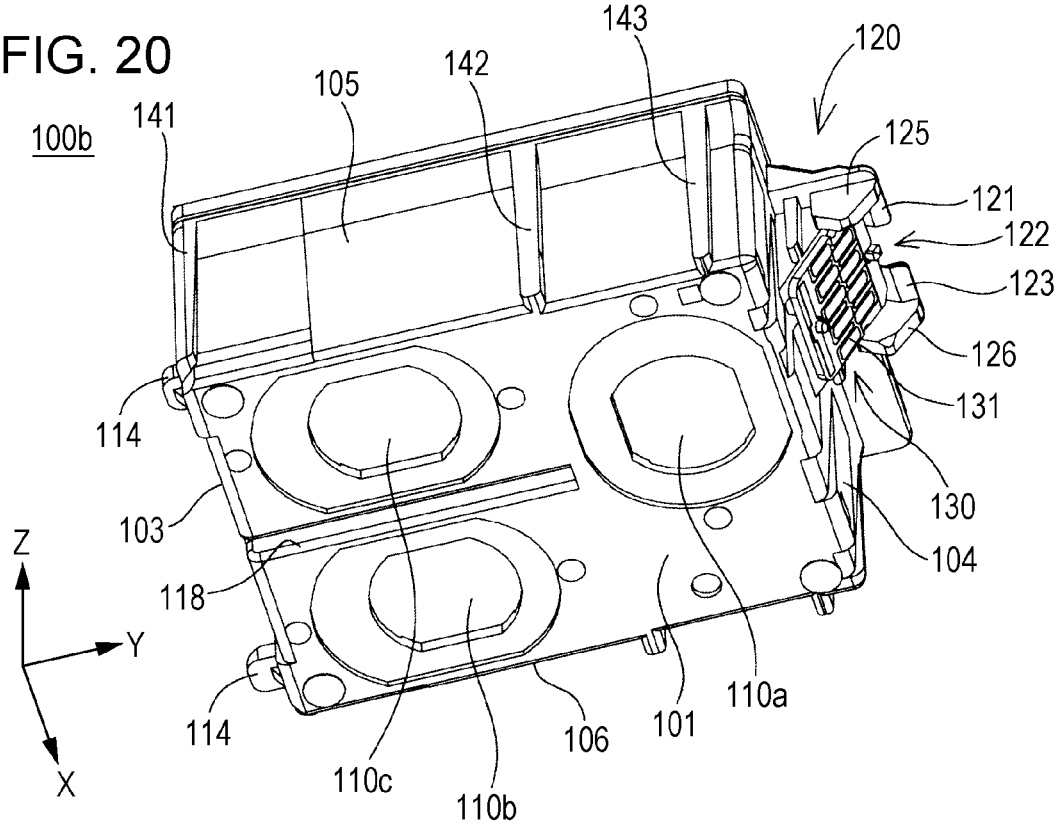
FIG. 20 is a lower part perspective view of the second cartridge.

A configuration of the second cartridge 100*b* will be described with reference to FIGS. 19 and 20. FIG. 19 is an upper part perspective view of the second cartridge 100*b*. In FIG. 19, ink chambers 108*a* to 108*c* which are formed inside the second cartridge 100*b* are denoted by a dash line for convenience. FIG. 20 is a lower part perspective view of the second cartridge 100*b*. In FIGS. 19 and 20, common configurations to those of the first cartridge 100*a* which are described in FIGS. 15 to 17 are given the same reference numerals. The second cartridge 100*b* has approximately the same configuration as that of the first cartridge 100*a* except for points which will be described below, and has six wall portions 101 to 106 corresponding to each of wall portions 101 to 106 of the first cartridge 100*a*.

The second cartridge 100*b* is configured so as to have a larger width than that of the first cartridge 100*a* in the arrow X direction in order to accommodate ink of three colors, and the inside thereof is partitioned into three ink chambers 108*a* to 108*c*. The first ink chamber 108*a* is formed in a region on the front side which faces the fourth wall portion 104. The second and third ink chambers 108*b* and 108*c* are respectively formed by dividing a region on the rear side into two in the arrow X direction using the first ink chamber 108*a*. The second ink chamber 108*b* is formed on the side facing the fifth wall portion 105, and the third ink chamber 108*c* is formed on the side facing the sixth wall portion 106. In the three ink chambers 108*a* to 108*c*, ink filling openings 115*a* to 115*c* corresponding thereto, respectively, are provided one by one.

Three ink supply openings 110*a* to 110*c* corresponding to each of ink chambers 108*a* to 108*c* are provided in the first wall portion 101 (FIG. 20). Each of the ink supply openings 110*a* to 110*c* is connected to one corresponding ink introducing port among the ink introducing ports 212 to 214 (FIG. 4) when the second cartridge 100*b* is mounted on the holder unit 200. A groove portion 118 which extends linearly in the arrow Y direction is formed at a position corresponding to a boundary position of the second and third ink chambers 108*b* and 108*c*. A second sub-wall portion 224 (FIG. 5) of the holder unit 200 engages with the groove portion 118 when the second cartridge 100*b* is mounted on the holder unit 200.

In the second cartridge 100*b*, the main engaging portion 120 is formed at a position which is close to a direction opposite to the arrow X direction compared to the center of an end portion which is close to the second wall portion 102. In this manner, the respective main engaging portions 120 are arranged by neighboring at a close position (FIG. 3) when both the first and second cartridges 100*a* and 100*b* are mounted on the holder unit 200.

Layout of Configuration in Holder Unit

Figure 21:
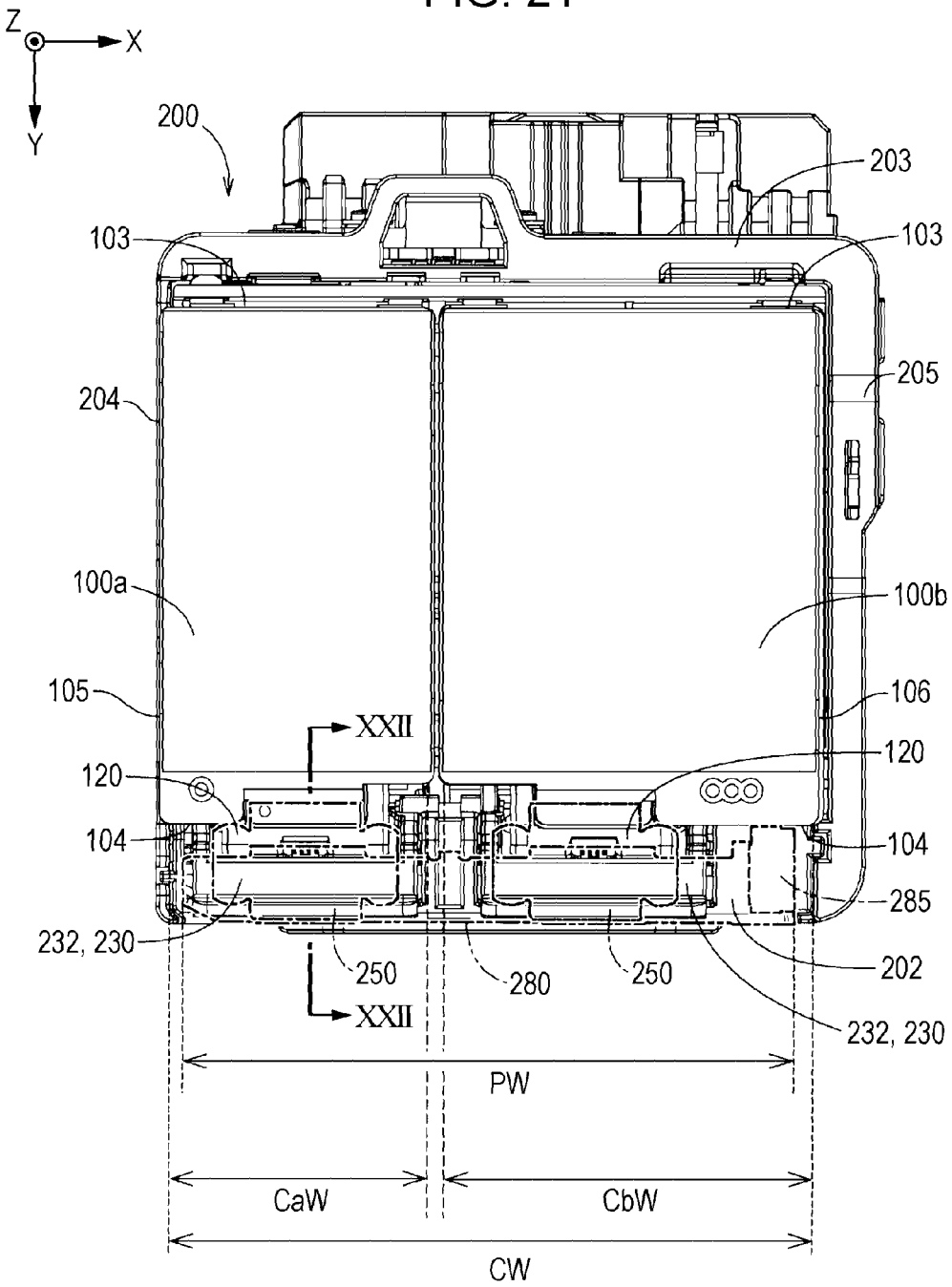
FIG. 21 is a schematic diagram which illustrates arranging regions of the connector unit and the wiring board in the holder unit.
Figure 22:
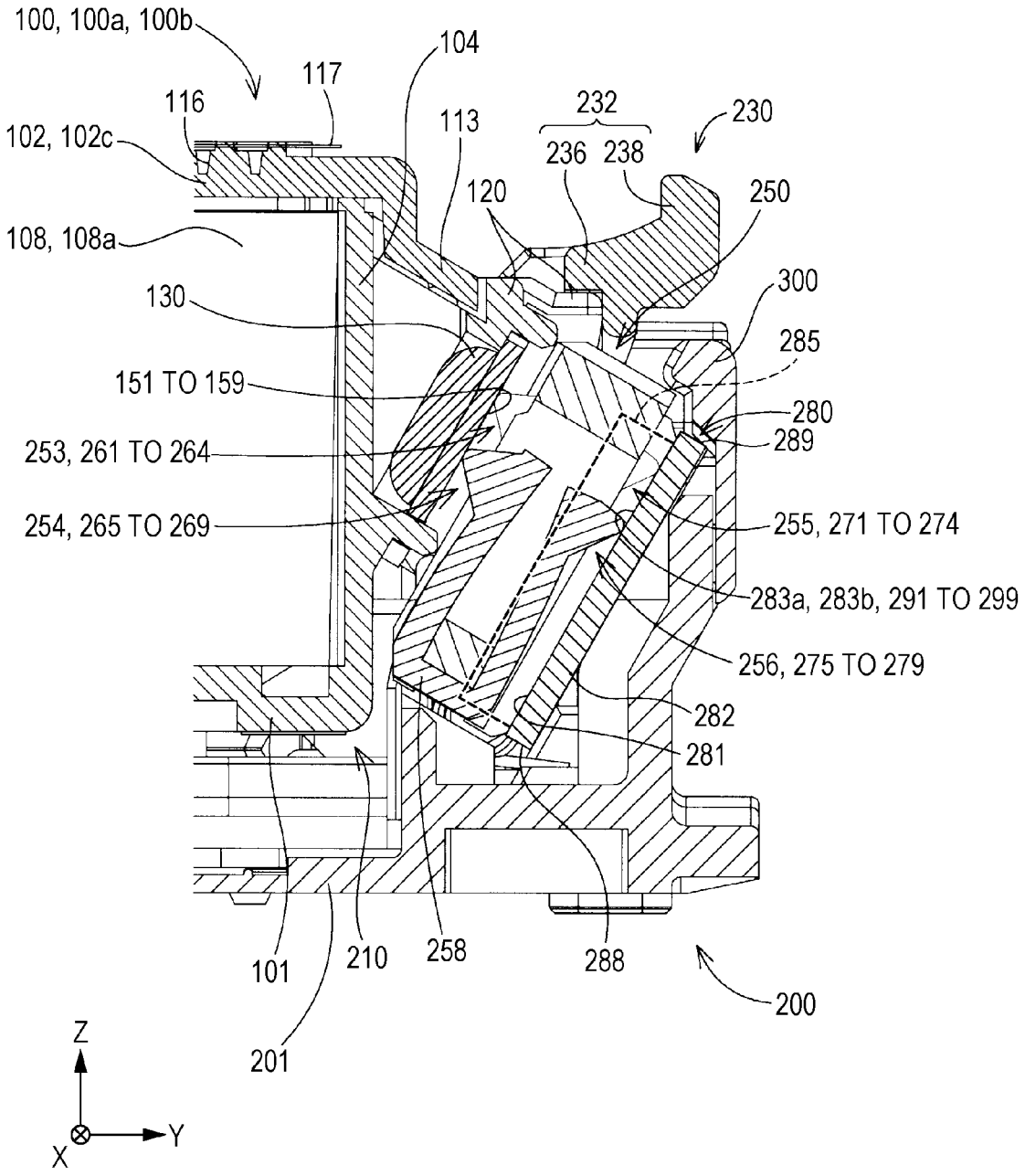
FIG. 22 is a schematic cross-sectional view of a vicinity portion of an electrical connection unit of the holder unit in a state of being mounted with the cartridge.

A layout of a configuration in the holder unit 200 will be described with reference to FIGS. 21 and 22. FIG. 21 is a schematic diagram which illustrates arranging regions of the connector unit 250 and the wiring board 280 in the holder unit 200. FIG. 21 illustrates the holder unit 200 when being viewed in a direction opposite to the arrow Z direction. In FIG. 21, both of the first and second cartridges 100*a* and 100*b* are mounted on the holder unit 200. In addition, in FIG. 21, an arranging region of the connector unit 250 and an arranging region of the wiring board 280 are denoted by one dot-dashed line, and two dot-dashed line, respectively. FIG. 22 is a schematic cross-sectional view of a vicinity portion (portion corresponding to line cut along XXII-XXII in FIG. 21) of an electrical connection unit of the holder unit 200 in a state of being mounted with the cartridge 100. In FIG. 22, an arranging region of the cable connection portion 285 on the wiring board 280 is denoted by a dash line for convenience. In FIG. 22, a schematic cross-sectional configuration of a vicinity portion of the electrical connection unit with the first cartridge 100*a* is denoted; however, the same applies to a schematic cross-sectional configuration of a vicinity portion of the electrical connection unit with the second cartridge 100*b*.

In the holder unit 200 according to the embodiment, the wiring board 280 extends in the arrow X direction over the respective arranging regions of the first and second cartridges 100*a* and 100*b* (FIG. 21). The arranging region of the wiring board 280 overlaps with the arranging region of the cartridge 100 in a direction which goes along the arrow Y. In addition, the width PW of the wiring board 280 in the arrow X direction is smaller than the width CW of the arranging region of the cartridge 100 in the arrow X direction.

Here, the above described "arranging region of the cartridge 100" corresponds to an arranging region of a fluid supply unit, and is a space which is occupied by the respective first and second cartridges 100*a* and 100*b* when the first and second cartridges 100*a* and 100*b* are mounted on the cartridge accommodating chamber 210 of the holder unit 200. In the space, a space which is occupied by a rib which is provided at the outside of a housing of the cartridge 100, an integrated component, or the like, is also included. A space between the cartridge 100 and each wall portion of the holder unit 200, or a space between the first and second cartridges 100*a* and 100*b* is not included in the arranging region of the cartridge 100.

"The width of the arranging region of the cartridge 100 in the arrow X direction" is a shortest distance between both ends of the arranging region of the cartridge 100 in the arrow X direction. According to the embodiment, the width is a shortest distance between the fifth wall portion 105 of the first cartridge 100*a* and the sixth wall portion 106 of the second cartridge 100*b*, that is, in the width, the width of a space between the first and second cartridges 100*a* and 100*b* is also included.

The direction which goes along the arrow Y corresponds to the first direction which goes toward the arranging region of the cartridge 100 from the wiring board 280. The direction which goes along the arrow X corresponds to the second direction which goes toward the cable connection portion 285 from the first and second electrode portions 283*a* and 283*b*, and goes along the first face 281. In addition, the direction which goes along the arrow X is also a main scanning direction of the carriage 27 in the printing apparatus 10. The direction which goes along the arrow Z corresponds to a third direction which intersects the first and second directions. In addition, the direction which goes along the arrow Z also corresponds to a direction in which the cartridge 100 is mounted on the holder unit 200, or a direction in which the cartridge 100 is retained to the lever member 230 of the holder unit 200.

The first and second electrode portions 283*a* and 283*b* of the wiring board 280, and the cable connection portion 285 are arranged along the arrow X direction between the arranging regions of the wiring board 280 and the cartridge 100. Two connector units 250 and the cable connection portion 285 of the wiring board 280 are arranged at a position which overlaps with the arranging region of the cartridge 100 in the direction which goes along the arrow Y. Each of the connector units 250 and the wiring board 280 are located at a position which overlaps with the bridge portion 232 of the lever member 230 in the direction which goes along the arrow Z. In addition, the main engaging portion 120 of the cartridge 100 is located at a position which overlaps with the connector unit 250 in the direction which goes along the arrow Z.

In the holder unit 200 according to the embodiment, two electrode portions 283*a* and 283*b*, and the cable connection portion 285 are integrated on the first face 281 of the wiring board 280, and the arranging region of the cable connection portion 285 overlaps with the connector unit 250 in the arrow X direction (FIG. 22). For this reason, the cable connection portion 285 does not protrude on the rear side of the wiring board 280, and the holder unit 200 is miniaturized in the arrow Y direction to that extent.

Here, for example, when the cable connection portion 285 is arranged on the second face 282 of the wiring board 280, the cable connection portion 285 protrudes on the rear side of the wiring board 280. In this case, when an arranging angle of the first face 281 of the wiring board 280 in the arrow Z direction is close to 0 degrees, the thickness of the cable connection portion 285 causes the length of the holder unit 200 in the arrow Y direction to be large. In contrast to this, in the holder unit 200 according to the embodiment, it is possible to increase the thickness of the cable connection portion 285 while suppressing an increase in size in the arrow Y direction.

In the holder unit 200 according to the embodiment, the left and right end portions of the wiring board 280 are not extended to the outside of the arranging region of the cartridge 100 in the arrow X direction (FIG. 21). That is, due to the wiring board 280, the holder unit 200 is prevented from being large in the arrow X direction. When the holder unit 200 is miniaturized in the direction which goes along the arrow X which is the main scanning direction, it is possible to increase a scannable range of the carriage 27 in a limited space in the printing apparatus 10. That is, in the carriage 27 according to the embodiment, it is possible to increase a scannable range of the printing apparatus 10 in the arrow X direction.

In addition, the connection port 285*i* of the cable connection portion 285 according to the embodiment opens in the arrow X direction. Accordingly, it is possible to prevent the wiring cable 30 (FIG. 3) from interfering with the second cartridge 100*b* in the direction which goes along the arrow Y. Accordingly, it is possible to prevent the holder unit 200 from being large in the arrow Y direction due to the arrangement of the wiring cable 30.

In the holder unit 200 according to the embodiment, the connector unit 250 and the wiring board 280 are arranged at the lower part of the bridge portion 232 of the lever member 230 (FIG. 22). In particular, in the holder unit 200 according to the embodiment, the wiring board 280 is arranged on the connector unit 250 side compared to the end portion in the operation portion 238 of the lever member 230 in the arrow Y direction. In addition, the connector unit 250 is arranged at the lower part of the main engaging portion 120 of the cartridge 100. In this manner, in the holder unit 200 according to the embodiment, a mechanism for retaining the cartridge 100, and the electrical connection unit are integrally arranged in the arrow Y direction, and the holder unit 200 is miniaturized in the arrow Y direction.

In addition, the second cartridge 100*b* according to the embodiment is located at a position in which the main engaging portion 120 which protrudes in the arrow Y direction, and the circuit board 130 are offset on the arranging region side of the first cartridge 100*a* from a center position in the arrow X direction (FIG. 21). In contrast to this, in the holder unit 200, the cable connection portion 285 which protrudes in a direction opposite to the arrow Y in the wiring board 280 is arranged at a position at which the main engaging portion 120 of the second cartridge 100*b* and the circuit board 130 are neighboring in the arrow X direction. In this manner, in the holder unit 200 according to the embodiment, a generation of dead space is suppressed, and space use efficiency increases.

In addition to this, in the wiring board 280 according to the embodiment, the first and second electrode portions 283*a* and 283*b* are arranged at positions of being close to each other in the arrow X direction, and the cable connection portion 285 is arranged at an end portion of the wiring board 280. That is, in the wiring board 280, each of configurations is integrally arranged according to a function, and a configuration thereof is simplified. In addition, since the cable connection portion 285 is located at the end portion of the wiring board 280, it is possible to make an arrangement and a connection of the wiring cable 30 from the outside of the carriage 27 easy. ps Conclusion of First Embodiment As described above, in the printing apparatus 10 according to the embodiment, a layout of each configuration including the electrical connection unit such as the connector unit 250 and the wiring board 280 has been studied in the holder unit 200 of the carriage 27, and efficiency of space use is increased. Accordingly, it is possible to make the carriage 27 of the printing apparatus 10 small and light, and to make the printing apparatus 10 small and light.

B. Second Embodiment

Figure 23:
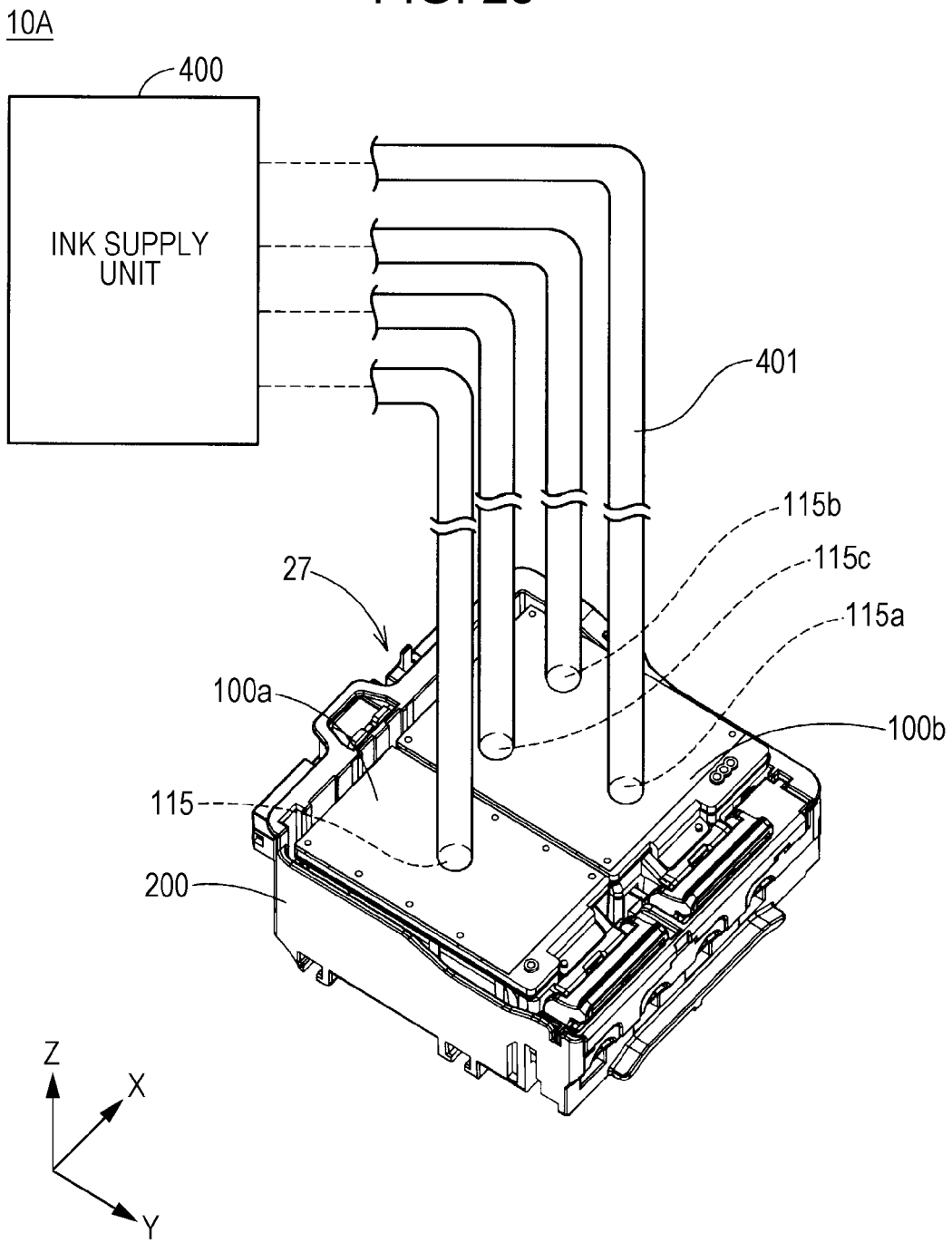
FIG. 23 is a schematic diagram which describes a configuration of a printing apparatus according to a second embodiment.

FIG. 23 is a schematic diagram which describes a configuration of a printing apparatus 10A according to a second embodiment of the invention. In FIG. 23, configurations other than a carriage 27, an ink supply unit 400, and an ink introducing pipe 401 are not illustrated for convenience. The printing apparatus 10A according to the second embodiment includes the same carriage 27 as that which is described in the first embodiment, and is mounted with the same cartridge 100 which is described in the first embodiment. The printing apparatus 10A according to the second embodiment has approximately the same configuration as that of the printing apparatus 10 in the first embodiment except for a point that the printing apparatus 10A is configured so as to continuously supply ink to the cartridge 100.

The printing apparatus 10A according to the second embodiment includes the ink supply unit 400, and a plurality of the ink introducing pipes 401. The ink supply unit 400 corresponds to a fluid container, and includes an ink container which stores ink of each color. The plurality of ink introducing pipes 401 correspond to ink of each color, and connects the ink container of the ink supply unit 400 to ink filling openings 115, and 115*a* to 115*c* of each color of the cartridge 100. The plurality of ink introducing pipes 401 are configured of, for example, a flexible resin tube.

In the printing apparatus 10A according to the second embodiment, the carriage 27 is miniaturized similarly to the printing apparatus 10 according to the first embodiment, and it is possible to make the printing apparatus 10A small. In addition, it is possible to obtain effects other than that which is described in the first embodiment, similarly. In addition to this, in the printing apparatus 10A according to the second embodiment, since ink is supplied from the ink supply unit 400 to the cartridge 100, it is possible to reduce a capacity of a space for accommodating ink in the cartridge 100. Accordingly, it is possible to make the cartridge 100 and the holder unit 200 smaller and lighter.

C. Third Embodiment

Figure 24:
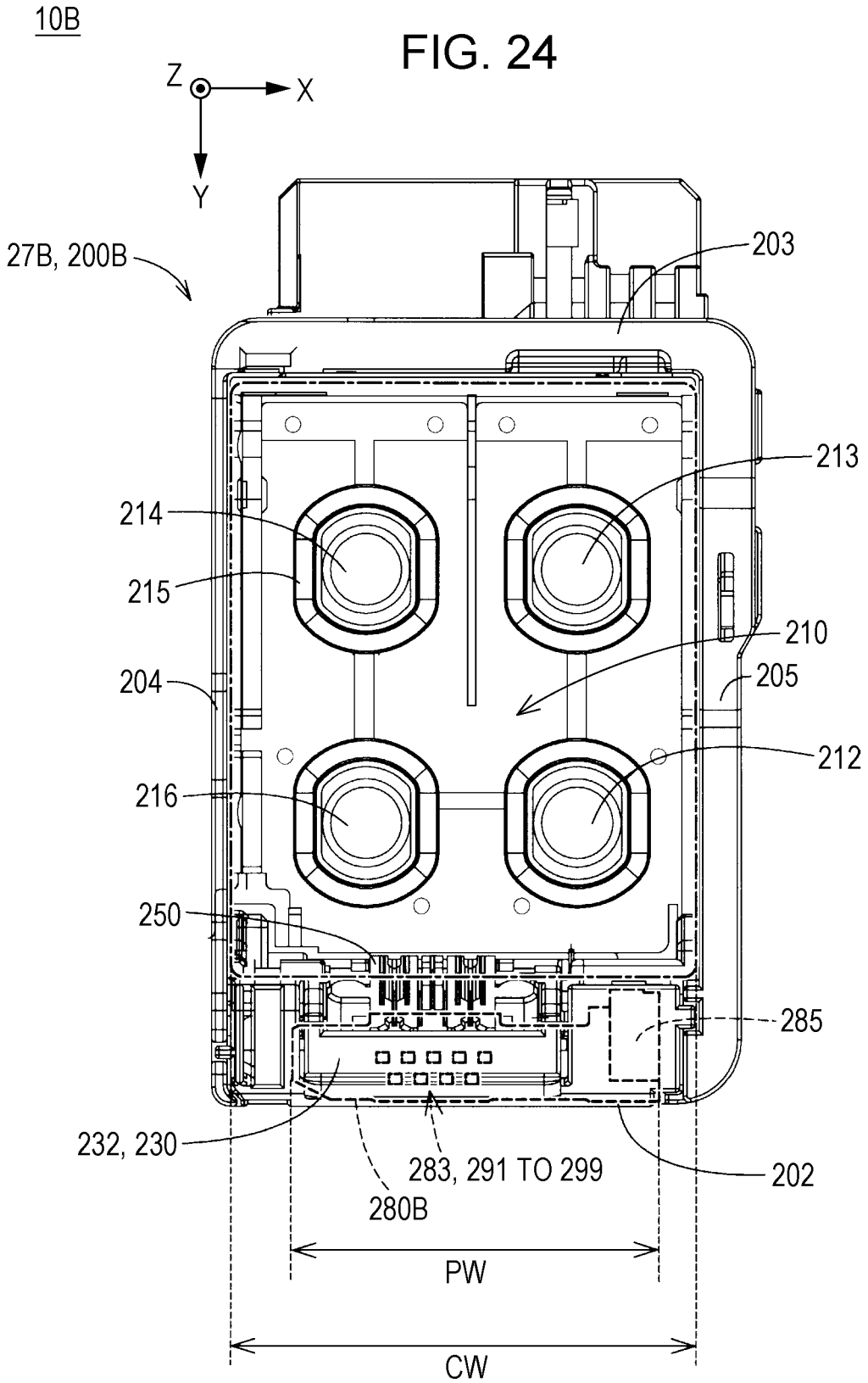
FIG. 24 is a schematic diagram which illustrates a configuration of a carriage which is included in a printing apparatus according to a third embodiment.

FIG. 24 is a schematic diagram which illustrates a configuration of a carriage 27B which is provided in a printing apparatus 10B according to a third embodiment. In FIG. 24, a holder unit 200 of the carriage 27B when being viewed in a direction opposite to the arrow Z direction is illustrated. In FIG. 24, a cartridge is not mounted on the holder unit 200 of the carriage 27B. In FIG. 24, an arranging region of a wiring board 280, and positions of an electrode portion 283 and a cable connection portion 285 are denoted by dash lines, and an arranging region of the cartridge is denoted by one dot-dash line.

Configurations other than the carriage 27B in the printing apparatus 10B according to the third embodiment are approximately the same as those in the first embodiment. A configuration of the carriage 27B according to the third embodiment is approximately the same as that of the carriage 27 in the first embodiment. In addition, the cartridge which is mounted on the carriage 27B according to the third embodiment has approximately the same configuration as that of the second cartridge 100*b* which is described in the first embodiment except for a point of being configured so as to supply ink of different four colors.

A holder unit 200B of the carriage 27B according to the third embodiment is configured so as to be mounted with one cartridge. A configuration of the holder unit 200B according to the third embodiment corresponds to a configuration in which a portion for accommodating the first cartridge 100*a* in the holder unit 200 according to the first embodiment is omitted. A configuration of the wiring board 280B which is arranged in the holder unit 200B according to the third embodiment corresponds to a configuration in which a portion at which the first electrode portion 283*a* is formed is omitted in the wiring board 280 according to the first embodiment.

In the holder unit 200B according to the third embodiment, a lever member 230 and a connector unit 250 are provided one by one. A fourth ink introducing port 216 is added to a base wall portion 201 of the holder unit 200B according to the third embodiment. Four ink introducing ports 212 to 214, and 216 are arranged approximately in a lattice shape in the inside of an ink accommodating chamber 210.

In the wiring board 280B according to the third embodiment, one electrode portion 283 which is electrically connected to the connector unit 250, and the cable connection portion 285 to which the wiring cable 30 is connected are arranged on the first face 281. In addition, the wiring board 280B is arranged at a position of being overlapped with the mounted cartridge in a direction which goes along the arrow Y. In addition, the width PW of the wiring board 280B in the arrow X direction is smaller than the width CW of the arranging region of the cartridge in the arrow X direction.

Also in the printing apparatus 10B according to the third embodiment, the carriage 27B is miniaturized, similarly to the carriage 27 in the first embodiment due to a layout of each configuration in the holder unit 200B. In addition to this, in the printing apparatus 10B according to the third embodiment, it is possible to obtain the same effect as that described in the first embodiment.

D. Fourth Embodiment

Figure 25:
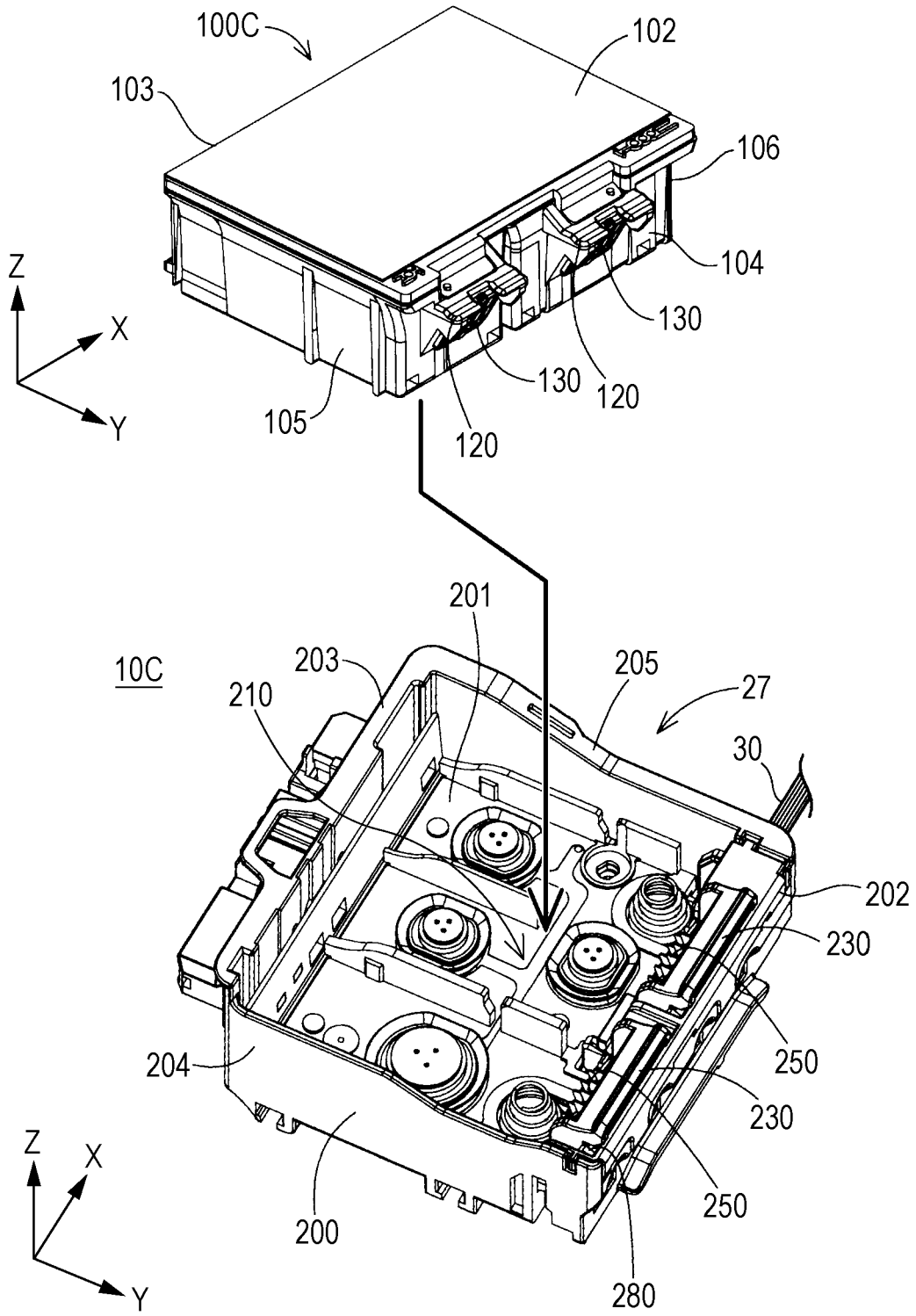
FIG. 25 is a schematic diagram which describes a configuration of a printing apparatus according to a fourth embodiment.

FIG. 25 is a schematic diagram which describes a configuration of a printing apparatus 10C according to a fourth embodiment. In FIG. 25, configurations other than a carriage 27 and a cartridge 100C which is mounted on the carriage 27 are not illustrated for convenience. The printing apparatus 10C according to the fourth embodiment includes the same carriage 27 which is described in the first embodiment. However, on the printing apparatus 10C according to the fourth embodiment, only one cartridge 100C corresponding to a cartridge in which first and second cartridges 100*a* and 100*b* are integrated is mounted. Also in the printing apparatus 10C according to the fourth embodiment, the carriage 27 is miniaturized similarly to that in the first embodiment. In addition to this, in the printing apparatus 10C according to the fourth embodiment, it is possible to obtain the same effect as that which is described in the first embodiment.

E. Modification Example

E1. Modification Example 1

In the above described first embodiment, the carriage 27 is configured so as to be mounted with the first cartridge 100*a* which accommodates ink of a single color, and a second cartridge 100*b* which accommodates ink of a plurality of colors at the same time. In contrast to this, the carriage 27 may be configured so as to be mounted with one cartridge which accommodates ink of a plurality of colors as in the third and fourth embodiments. Alternatively, the carriage 27 may be configured so as to be mounted with only ink of a single color, or may be configured so as to be mounted with a cartridge which accommodates ink of a single color, or a plurality of cartridges which accommodate ink of a plurality of colors at the same time. In the carriage 27, the plurality of cartridges may not be arranged in the arrow X direction, and may be arranged in the arrow Y direction.

E2. Modification Example 2

In the above described each embodiment, the cartridges 100 and 100C which are the fluid supply units are retained to the holder units 200 and 200B of the carriages 27 and 27B using the rotatable lever member 230. In contrast to this, the cartridges 100 and 100C may be retained using a retaining portion other than the rotatable lever member 230 to the holder units 200 and 200B of the carriages 27 and 27B. For example, the cartridges 100 and 100C may be retained to the holder units 200 and 200B using a slider-type lever member which can linearly move in the arrow Y direction, a convex portion of which a position is fixed, a step portion, or the like. In addition, in the holder units 200 and 200B, the retaining portion for retaining the cartridges 100 and 100C may be omitted. The cartridges 100 and 100C may have a configuration of being simply placed without being retained to the holder unit 200.

E3. Modification Example 3

In the above described each embodiment, the width PW of the wiring boards 280 and 280B in the arrow X direction is configured so as to be smaller than the width CW of the arranging regions of the cartridges 100 and 100C in the arrow X direction (PW<CW). In contrast to this, the width PW of the wiring boards 280 and 280B in the arrow X direction may be approximately the same as the width CW of the arranging regions of the cartridges 100 and 100C. The width PW of the wiring boards 280 and 280B in the arrow X direction may be the same as the width CW of the arranging regions of the cartridges 100 and 100C, or may be smaller than the width CW (PW≤CW).

E4. Modification Example 4

In the above described each embodiment, the holder units 200 and 200B include wall portions 201 to 205 which surround the inside of the ink accommodating chamber 210, in the carriages 27 and 27B. In contrast to this, all or a part of the wall portions 201 to 205 of the holder units 200 and 200B may be omitted. The holder units 200 and 200B of the carriages 27 and 27B may be configured so as to arrange the cartridges 100 and 100C, and may have a configuration in which columnar frame members are assembled in a lattice shape, for example, instead of the above described wall portions 201 to 205.

E5. Modification Example 5

In the above described each embodiment, the wiring boards 280 and 280B as wiring bases which are provided in the carriages 27 and 27B have plate shapes. In contrast to this, the wiring base which is included in the carriages 27 and 27B may not have the plate shape. The wiring base which is included in the carriages 27 and 27B may have a polygonal pillar shape, or may have a semi-cylindrical shape. The wiring base which is included in the carriages 27 and 27B may have a base face on which the electrode portion and the cable connection portion are arranged. In addition, in the above described each embodiment, the electrode portions 283*a* and 283*b* of the wiring boards 280 and 280B are arranged so as to be close to an upper end 289. In contrast to this, the electrode portions 283, 283*a* and 283*b* of the wiring boards 280 and 280B may be arranged at a position which is close to a lower end 288, for example, or may be arranged in the vicinity of a center of the upper end 289 and the lower end 288.

E6. Modification Example 6

In the above described each embodiment, the electrical connection unit of the carriages 27 and 27B which is configured of the connector unit 250, and the wiring boards 280 and 280B is arranged in the front face wall portion 202 of the holder unit 200. In contrast to this, the electrical connection unit which includes the connector unit 250, and the wiring boards 280 and 280B may be provided at a portion other than the front face wall portion 202 of the holder unit 200. The electrical connection unit which includes the connector unit 250, and the wiring boards 280 and 280B may be provided in the rear face wall portion 203, the first side face wall portion 204, or the second side face wall portion 205 in the holder units 200 and 200B. In this case, the main scanning direction in which the carriages 27 and 27B reciprocate does not match the second direction.

E7. Modification Example 7

In the above described each embodiment, the lever member 230 which is a retaining portion is arranged at the upper part of the connector unit 250 and the wiring boards 280 and 280B. In contrast to this, the lever member 230 may be provided at a position other than the upper part of the connector unit 250 and the wiring boards 280 and 280B. The lever member 230 may be provided at the rear face wall portion 203, or the first side face wall portion 204 and the second side face wall portion 205.

E8. Modification Example 8

In the above described each embodiment, the cable connection portion 285 is configured as a mounted component which is attached to the first face 281 of the wiring boards 280 and 280B. In contrast to this, the cable connection portion 285 may be configured as a portion at which the wiring cable 30 is soldered to the first face 281 of the wiring boards 280 and 280B. In this manner, it is possible to miniaturize the wiring boards 280 and 280B in the thickness direction thereof. In addition, it is possible to make the wiring boards 280 and 280B light.

E9. Modification Example 9

In the above described each embodiment, the wiring cable 30 is connected in a direction opposite to the arrow X direction which goes along the first face 281 when the connection port 285*i* of the cable connection portion 285 of the wiring boards 280 and 280B is open in the direction which goes along the arrow X. In contrast to this, the connection port 285*i* of the cable connection portion 285 may be open in a direction other than the direction which goes along the arrow X. For example, the connection port 285*i* of the cable connection portion 285 may be open toward the upper part or the lower part along the first face 281, or may be open in a direction perpendicular to the first face 281.

E10. Modification Example 10

In the above described first, second, and fourth embodiments, the first and second electrode portions 283*a* and 283*b* of the wiring board 280 is connected to the cable connection portion 285 in parallel using the wiring group 284. In contrast to this, the first and second electrode portions 283*a* and 283*b* may be individually connected to the cable connection portion 285, respectively.

E11. Modification Example 11

In the above described each embodiment, in the connector unit 250 and the wiring boards 280 and 280B, a face with a terminal is arranged with an angle of inclination in the arrow Z direction. In contrast to this, in the connector unit 250 and the wiring board 280, the face with the terminal may be arranged so as to be approximately parallel in the arrow Z direction. In addition, in the above described each embodiment, the lower end of the connector unit 250, and the lower end 288 of the wiring boards 280 and 280B are located at positions with approximately the same height in the arrow Z direction. However, the lower end of the connector unit 250, and the lower end 288 of the wiring boards 280 and 280B may be arranged at positions which are offset to each other in the arrow Z direction.

E12. Modification Example 12

The connector unit 250, and the wiring boards 280 and 280B in each of the above described embodiments include nine-type terminals, respectively, and have nine contact points. In contrast to this, the types of the terminal of the connector unit 250 and the wiring boards 280 and 280B may be smaller than nine types. For example, it may be one type. Alternatively, the types of the terminal of the connector unit 250 and the wiring board 280 may be larger than nine types. For example, it may be ten types. The number of contact points between the connector unit 250 and the wiring board 280 may be increased or decreased according to the number of types of the terminal. In addition, in the connector unit 250 and the wiring board 280 in the above described each embodiment, a plurality of terminals are arranged in vertical two lines, and the contact portions CPa are arranged in horizontal two lines. In contrast to this, in the connector unit 250 and the wiring board 280, only one line of the plurality of terminals, and only one line of the contact portion CPa may be arranged, and three or more lines may be vertically arranged. In addition, the plurality of terminals, and the contact portion CPa may not form a line, and may be randomly arranged on the faces of the connector unit 250 and the wiring board 280. In addition to this, a shape and an arrangement configuration of each of electrodes 291 to 299 of the first and second electrode portions 286*a* and 286*b* which are provided in the wiring board 280 may not be the same, and may have configurations which are different from each other.

E13. Modification Example 13

In the above described each embodiment, each of the terminals 261 to 269 on the terminal portion front surface 251 of the connector unit 250 is in direct contact with each of the terminals 151 to 159 in the circuit board 130 of the cartridge 100. In addition, each of the terminals 271 to 279 on the terminal portion rear surface 252 of the connector unit 250 is in direct contact with each of the electrodes 291 to 299 in the wiring boards 280 and 280B. In contrast to this, each of the terminals 261 to 269 on the terminal portion front surface 251 of the connector unit 250 may be in electrical contact with each of the terminals 151 to 159 in the circuit board 130 of the cartridge 100, and may be in contact with the terminals through another conductive member. Similarly, each of the terminals 271 to 279 on the terminal portion rear surface 252 of the connector unit 250 may be in contact with each of the electrodes 291 to 299 in the wiring boards 280 and 280B through another conductive member.

E14. Modification Example 14

The connector unit 250 in the above described each embodiment has an approximately flat plate shape. In contrast to this, the connector unit 250 may have a shape other than the approximately flat plate shape. A cross-sectional shape of the connector unit 250 which is parallel in the arrow Y direction is in an approximately trapezoidal shape, and angles with respect to the terminal portion front surface 251 and the terminal portion rear surface 252 in the arrow Z direction may be different, respectively. A side of the connector unit 250 which faces the cartridge accommodating chamber 210 or the wiring board 280 may be configured of a curved surface.

E15. Modification Example 15

The connector unit 250 in the above described each embodiment includes each of the terminals 261 to 269 and 271 to 279 which is in an approximately triangular shape, and the plate-shaped conductive member 258 which includes two extension portions 258*a* and 258*b*, and the folded portion 258*t*. In contrast to this, each of the terminals 261 to 269 and 271 to 279 of the connector unit 250 may not have the approximately triangular shape, and for example, may be configured as a hemispherical convex portion. Alternatively, each terminal may be configured as a flat plate-shaped electrode. In addition, the plate-shaped conductive member 258 may be configured so as to be elastically deformed, and each of the terminals 261 to 269 and 271 to 279 may be electrically connected using a conductive wire or a printed wiring pattern instead of the plate-shaped conductive member 258.

E16. Modification Example 16

In the above described each embodiment, carriages 27 and 27B are configured so as to reciprocate in the direction which goes along the arrow X which is set to be the main scanning direction. In contrast to this, the carriages 27 and 27B may be configured so as to reciprocate in a direction other than the direction which goes along the arrow X. The printing apparatuses 10 and 10B may be configured as a plotter which is configured so that the carriages 27 and 27B can move in two directions of the arrows X and Y. Alternatively, the carriages 27 and 27B may be configured so as not to reciprocate, and may be fixed to a fixed position. The printing apparatuses 10 and 10B may be configured as a line printer.

E17. Modification Example 17

In the above described each embodiment, the circuit board 130 of the cartridges 100 and 100C protrude in the arrow Y direction. In contrast to this, the circuit board 130 may not protrude in the arrow Y direction, and may be embedded in the fourth wall portion 104.

E18. Modification Example 18

The cartridges 100 and 100C in the above described each embodiment include the main engaging portion 120 which is retained to the lever member 230 of the holder units 200 and 200B. In contrast to this, the main engaging portion 120 of the cartridges 100 and 100C may have a different configuration. The main engaging portion 120 of the cartridge 100 may not protrude in the arrow Y direction, and may be configured as a step portion, a groove portion, a concave portion, or a hole portion on the front surface of the housing of the cartridges 100 and 100C, for example. The main engaging portion 120 may not be located on the upper part of the connector unit 250 or the wiring board 280 in a state in which the cartridges 100 and 100C are mounted on the holder units 200 and 200B.

E19. Modification Example 19

The cartridges 100 and 100C in the above described each embodiment includes an approximately rectangular parallelepiped housing which has six wall portions 101 to 106. In contrast to this, the cartridge 100 may not include the approximately rectangular parallelepiped housing which has six wall portions 101 to 106. The cartridge 100 may have a configuration in which a flexible bag-shaped member in which ink is accommodated in a frame which is configured as a columnar frame is held.

E20. Modification Example 20

The fluid ejecting apparatus in the invention can also be realized in embodiments other than the printing apparatuses 10, and 10A to 10C, which are ink jet printers described in the above described embodiments and the modification examples. The fluid ejecting apparatus in the invention may be configured as a high pressure cleaning device which performs cleaning by ejecting liquid such as cleaning liquid to a cleaning target, for example. The fluid ejecting apparatus in the invention may be configured as a powder ejecting apparatus or air ejecting apparatus which ejects powder or air as a fluid, for example. In addition, the fluid ejecting apparatus in the invention may be configured as a spray device which ejects a fluid as spray.

The invention is not limited to the above described embodiments, examples, or modification examples, and can be executed in various configurations without departing from the scope of the invention. For example, technical characteristics in the embodiment, examples, and modification examples corresponding to technical characteristics in each embodiment which are described in the summary of the invention can be appropriately replaced or combined in order to solve a part, or all of above described problems, or to achieve a part, or all of above described effects. In addition, when the technical characteristics are not described as essential characteristics in the specification, the technical characteristics can be appropriately deleted.

What is claimed is:

1. A fluid ejecting apparatus to which at least a first cartridge and a second cartridge are removably attached the first cartridge having a plurality of first-cartridge-side terminals and the second cartridge having a plurality of second-cartridge-side terminals, the fluid ejecting apparatus comprising:

a wiring cable configured to transmit an electrical signal to the cartridges; and a carriage comprising:

a cartridge arranging region in which the cartridges are configured to be arranged in an X-direction;

a first connector having a plurality of first-apparatus-side terminals configured to be in electrical contact with the first-cartridge-side terminals;

a second connector having a plurality of second-apparatus-side terminals configured to be in electrical contact with the second-cartridge-side terminals;

a wiring board mediating an electrical connection between the first connector, the second connector and the wiring cable;

a first electrode portion provided on the wiring board, the first electrode portion being electrically connected with the first connector;

a second electrode portion provided on the wiring board, the second electrode portion being electrically connected with the second connector; and a cable connection portion to which the wiring cable is attached, the cable connection portion being provided on the wiring board, wherein the wiring board is overlapped with the cartridge arranging region when viewed along a Y-direction intersecting the X-direction, and a width of the wiring board in the X-direction is the same as a width of the cartridge arranging region in the Y-direction, or is smaller than the width of the cartridge arranging region in the X-direction.

2. The fluid ejecting apparatus according to claim 1, wherein, in a state where the cartridges are arranged in the cartridge arranging region, the connectors and the cable connection portion are overlapped with the cartridges in the Y-direction.

3. The fluid ejecting apparatus according to claim 1, wherein the carriage is configured so as to reciprocate along the X-direction.

4. The fluid ejecting apparatus according to claim 1, wherein the cable connection portion comprises a fitting connection which is attached to the wiring board, and the wiring cable is connected to the fitting connection.

5. The fluid ejecting apparatus according to claim 4, wherein the wiring cable is connected to the fitting connection along the X-direction.

6. The fluid ejecting apparatus according to claim 1, wherein the wiring cable is soldered to the wiring board.

7. The fluid ejecting apparatus according to claim 1, the carriage including a retaining portion which is configured to limit a movement of the cartridges in a direction in which the cartridges are separated from the cartridge arranging region, and wherein the retaining portion is overlapped with at least a part of the wiring board and at least a part of the connectors, when the carriage is viewed along a Z-direction intersecting the Y-direction and the X-direction.

8. The fluid ejecting apparatus according to claim 1, further comprising:

a wiring group provided on the wiring board, the wiring group electrically connecting the wiring cable and the first and second electrode portions in parallel through the cable connection portion.

9. The fluid ejecting apparatus according to claim 1, wherein a width of the second cartridge in the X-direction is larger than a width of the first cartridge in the X-direction, and wherein the cable connection portion and the second electrode portion are overlapped with the second cartridge in the Y-direction.

10. The fluid ejecting apparatus according to claim 1, wherein the wiring board is comprised of a flexible wiring board.

11. The fluid ejecting apparatus according to claim 1, wherein the cartridges are arranged in the carriage, the cartridges including:

a first portion overlapped with the connectors in the Y-direction; and a second portion overlapped with the cable connection portion in the Y-direction, wherein the cartridge-side terminals which can be in electrical contact with the connectors are arranged at the first portion, and wherein the first portion protrudes toward the connectors compared to the second portion, in the Y-direction.

12. The fluid ejecting apparatus according to claim 1, wherein:

the cartridges are arranged in the carriage, and the cartridges include a housing which is arranged in the cartridge arranging region, and a fluid introduction pipe which communicates with the housing.

13. The fluid ejecting apparatus according to claim 12, wherein the cartridges include a fluid container which communicates with the fluid introduction pipe.

* * * * *